US006110635A

United States Patent [19]

Urata et al.

[11] Patent Number: 6,110,635

[45] Date of Patent: Aug. 29, 2000

[54] TONER FOR ELECTROPHOTOGRAPHY AND A PRODUCTION METHOD THEREOF

[75] Inventors: Yoshinori Urata, Kashihara; Tatsuo Imafuku, Nara; Toshihisa Ishida, Kashiba; Takahiro Bito; Tadashi Nakamura, both of Nara; Yoshiaki Akazawa, Osaka; Yasuharu Morinishi; Nobuyasu Honda, both of Tenri, all of Japan

[73] Assignee: Sharp Kabushiki Kaisha, Osaka, Japan

[21] Appl. No.: 09/150,738

[22] Filed: Sep. 10, 1998

[30] Foreign Application Priority Data

Oct. 7, 1997 [JP] Japan ..... 9-274330
Mar. 24, 1998 [JP] Japan ..... 10-075312

[51] Int. Cl.[7] ..... G03G 9/097

[52] U.S. Cl. ..... 430/137; 430/110; 430/111

[58] Field of Search ..... 430/110, 111, 430/137

[56] References Cited

U.S. PATENT DOCUMENTS

| | | | |
|---|---|---|---|
| 5,176,978 | 1/1993 | Kumashiro et al. | 430/110 |
| 5,244,765 | 9/1993 | Katoh et al. | 430/110 |
| 5,474,871 | 12/1995 | Takagi et al. | 430/137 |
| 5,612,160 | 3/1997 | Inoue et al. | 430/110 |
| 5,627,000 | 5/1997 | Yamazaki et al. | 430/99 |
| 5,643,705 | 7/1997 | Inoue et al. | 430/110 |
| 5,679,491 | 10/1997 | Oshiba et al. | 430/110 |
| 5,688,625 | 11/1997 | Bertrand | 430/110 |
| 5,798,200 | 8/1998 | Matsuura et al. | 430/98 |
| 5,843,612 | 12/1998 | Lin et al. | 430/110 |
| 5,858,596 | 1/1999 | Tajima et al. | 430/110 |
| 5,935,751 | 8/1999 | Matsuoka et al. | 430/110 |

FOREIGN PATENT DOCUMENTS

| | | |
|---|---|---|
| 7-271094 | 10/1995 | Japan . |
| 8-44113 | 2/1996 | Japan . |
| 2583754 B2 | 11/1996 | Japan . |

OTHER PUBLICATIONS

Database WPI, Section Ch, Week 9243, Derwent Publications Ltd., London, GB, Class A89, AN 92–353661 XP002088164 & JP 04 255865 A (Fuji Xerox Co Ltd), Sep. 10,1992.

Patent Abstracts of Japan, vol. 97, No. 12, Dec. 25 1997 & JP 09 218538 A (Konica Corp), Aug. 19,1997.

*Primary Examiner*—Roland Martin
*Attorney, Agent, or Firm*—Nixon & Vanderhye P.C.

[57] ABSTRACT

A binder resin as the main component of the toner has a low molecular weight polypropylene as a separating agent, encapsulated therein. Using this binder a toner with the wax having a diameter of 0.3 $\mu$m or less dispersed therein is produced. The wax is included 0.5 part to 5 parts by weight for 100 parts by weight of the binder resin. This limitation of the toner prevents the setoff phenomenon during the fixing process and at the same time prevents the filming phenomenon over the photoreceptor and achieves an improved fixing performance.

8 Claims, 2 Drawing Sheets

TONER FOR ELECTROPHOTOGRAPHY AND A PRODUCTION METHOD THEREOF

BACKGROUND OF THE INVENTION (1) Field of the Invention

The present invention relates to a toner for electrophotography for visualizing the latent image formed on the image support provided for an image forming apparatus using the electrophotographic technology, such as a copier, printer, facsimile machine, or the like, as well as relating to a production method of the toner.

(2) Description of the Prior Art

In an image forming apparatus using the electrophotographic technology, such as a copier, printer, facsimile machine or the like, a static latent image is formed on the photoreceptor surface as a static latent image support. In order to visualize this latent image, the apparatus has a developing unit which supplies the developer, e.g., toner, etc., as a coloring agent, to the photoreceptor so as to make the toner adhere thereto.

The static latent image formed on the photoreceptor is developed through the aforementioned developing unit, and the thus developed, toner image is transferred to a sheet of paper as printing paper. After the transfer station, part of the toner, which could not be completely transferred, will be left over on the aforementioned photoreceptor surface. This unused, leftover toner needs to be removed from the photoreceptor surface in order to perform subsequent image forming. For this purpose, a cleaning unit for removal of the toner left over on the photoreceptor surface is provided after the transfer station. The leftover toner removed by the cleaning unit is collected by the collecting portion inside the cleaning unit.

Since the toner image transferred to a sheet of paper remains unfixed, it is subjected to fixing to the sheet. This fixing process usually uses thermal pressing. For example, a fixing unit comprises a heat roller disposed on the side in contact with the toner image and heated at a temperature allowing for the fusion of the toner, a pressing roller which is urged by an appropriate pressure to bring the sheet with a toner image thereon into close contact with the heat roller. This thermal pressing type fixing unit thus configured has been widely used because of its improved thermal efficiency and high fixing efficiency.

However, while this fixing process provides an increased thermal efficiency, but it suffers from the problem of setoff in that the heat roller surface makes contact with the fusing toner and hence the toner transfers to the heat roller surface, and in turn is transferred to a next sheet. In order to eliminate this problem, a cleaner is provided to clean the heat roller surface after the fixing process. Even when this kind of cleaner is used, there are cases where the toner having stuck can not be removed completely. Also to deal with this, a means for preventing the toner from sticking to the heat roller is provided.

One example of this is the application or coating of an anti-setoff agent onto the heat roller. For example, a separation agent such as silicone oil presenting a good separation performance with respect to the toner is applied over the heat roller so that the toner supported on the sheet will not adhere to the heat roller during the fixing process.

As another example, there is a preparation of toner which itself is designed not to adhere to the heat roller. For example, in the process of producing the toner, when the ingredients for the toner are mixed, a separation agent such as low molecular weight polypropylene wax etc., is added so as to be dispersed during fusing and kneading. This method prevents the toner supported by the sheet from adhering to the heat roller.

A toner having wax as a separation agent contained therein and its production method in order to prevent the setoff phenomenon are disclosed, for example, in Japanese Patent Publication 2,583,754. This toner contains low-molecular waxes so as to provide a separation performance. This improves the anti-setoff performance. The waxes here include polyolefin, polypropylene, polyethylene etc.

As stated above, by the selection of waxes to be contained in the toner, it is possible to prevent its adherence to the heat roller, and hence this type of toner is effective in eliminating the setoff phenomenon, that is, the adherence of the toner to the heat roller etc., during fixing.

On the other hand, if a lot of wax is used in order to solve the problem of the dispersion performance of the wax and in order to provide high enough separation performance, the wax adheres to the photoreceptor upon development, causing a new problem, that is, occurrence of image defects. Specifically, if wax adheres to the photoreceptor, it cannot be removed by the cleaner, and will adhere to the photoreceptor surface in film-like forms, which will be called 'filming phenomenon'.

This phenomenon degrades the photoreceptor characteristics, causing the increase and/or decrease of the image density, fogging, and other defects, which significantly influences the image quality. This problem does not only stem from the toner, but is also considered to be attributed to the elevation of temperature within the developing unit with the development of the performance of the image forming apparatus into high speed one.

For the above reasons, a preparation of toner is needed which, without using a lot of wax, can eliminate the setoff phenomenon during fixing whilst eliminating the filming over the photoreceptor, to thereby provide stable image quality.

Further there is a concern in that deterioration of the toner or developer due to the elevation of temperature within the developing unit might degrade the image quality and fixing performance. So a toner which can also solve these problems together with the aforementioned problem has been desired.

In the case where the toner is mainly composed of a high polymer, high-elasticity resin, uniform dispersion of wax components throughout the toner is very difficult in view of manufacture, because of the optimization of fusing and kneading and cooling steps during the toner manufacturing. More illustratively, if the thickness of the mixture during rolling and cooling was set at 1.2 mm or more, the resulting mixture after the rolling would be 3 mm or more in thickness due to the elasticity of the resin, and would cause clogging in the cooling and crushing process due to insufficient cooling. Therefore, the clearance must be set at 1.2 mm or less because of the characteristic of the resin. However, it is difficult, in general, to uniformly disperse waxes under such manufacturing conditions. So, filming, setoff and other defects have occurred.

SUMMARY OF THE INVENTION

The present invention has been devised to provide a toner which is free from the above diverse problems, and it is therefore an object of the present invention to provide a toner which can prevent the occurrence of the setoff phenomenon and the occurrence of the filming phenomenon accompanied by setoff, by manipulating the addition of a wax contained in the toner.

It is another object of the invention to provide a toner in which the wax component is uniformly dispersed even when the manufacturing conditions concerning the dispersion of the wax are not optimized. That is, the wax component is dispersed and encapsulated with an optical domain diameter into the binder resin as the main component of the toner, to thereby provide a toner which contain a wax having a prescribed diameter dispersed therein and can thereby achieve prevention of the aforementioned filming and setoff problems and a beneficent fixing performance.

A further object of the invention is, whilst achieving the above objects, to solve the above-described conventional toner problems by providing a toner having an improved fixing performance, in consideration of the toner production process for providing the toner.

In order to achieve the above objects of the invention, the inventor hereof has found that a toner in which a low molecular weight polypropylene as a wax serving as a separation agent is encapsulated in the binder resin as the main component of the toner, is markedly effective in preventing the filming phenomenon from occurring.

The present invention has been devised to achieve the above objects and the present invention is configured as follows:

In accordance with the first aspect of the invention, a toner for electrophotography is characterized in that a binder resin as the main component thereof contains therein a low molecular weight polypropylene wax having a dispersion diameter of 0.3 $\mu$m or less.

Next, in accordance with the second aspect of the invention, the toner for electrophotography having the above first feature is characterized in that the low molecular weight polypropylene wax is included 0.5 part to 5 parts by weight for 100 parts by weight of the binder resin.

In accordance with the third aspect of the invention, a toner for electrophotography, comprises, as the main component, a binder resin in which a wax is encapsulated, and is characterized in that the domain diameter of the wax encapsulated in the binder resin falls within the range of 1.0 $\mu$m to 3.0 $\mu$m, and the domain diameter of the wax dispersed in the toner for electrophotography after production falls within the range of 0.1 $\mu$m to 1.0 $\mu$m.

In accordance with the fourth aspect of the invention, the toner for electrophotography having the above third feature is characterized in that the wax is included 0.1 part by weight or more but less than 5.0 parts by weight for 100 parts by weight of the binder resin.

In accordance with the fifth aspect of the invention, the toner for electrophotography having the above first feature is characterized in that the molecular weight distribution of the binder resin is specified so that the number average molecular weight Mn of the high polymer component of the binder resin falls within the range of $1.0\times10^5 \leqq Mn \leqq 2.5\times10^5$ and the number average molecular weight Mn of the low molecular weight component falls within the range of $2.0\times10^3 \leqq Mn \leqq 3.2\times10^3$.

In accordance with the sixth aspect of the invention, the toner for electrophotography having the above third feature is characterized in that the molecular weight distribution of the binder resin is specified so that the number average molecular weight Mn of the high polymer component of the binder resin falls within the range of $1.0\times10^5 \leqq Mn \leqq 2.5\times10^5$ and the number average molecular weight Mn of the low molecular weight component falls within the range of $2.0\times10^3 \leqq Mn \leqq 3.2\times10^3$.

In accordance with the seventh aspect of the invention, the toner for electrophotography having the above third feature is characterized in that the wax encapsulated in the binder resin is of a low molecular weight polypropylene wax having a number average molecular weight Mn of 6,000 to 8,000.

In accordance with the eighth aspect of the invention, the toner for electrophotography having the above third feature is characterized in that the binder resin is produced by a solution polymerization process and the wax encapsulated in the binder is of a low molecular weight polypropylene wax having a softening temperature of 145° C. to 165° C.

In accordance with the ninth aspect of the invention, a toner production process for preparing a toner for electrophotography, comprises the steps of: using a binder resin, as the main component, with a low molecular weight polyethylene wax having a dispersion diameter of 0.3 $\mu$m or less encapsulated therein, and fusing and kneading a mixture of ingredients for the toner at a temperature in the range of M±5° C., where M° C. is the 4 mm softening temperature of the binder resin.

The toner of the invention is optimized by finding a pertinent range of the dispersion diameter of the low molecular polypropylene encapsulated in the resin, to thereby improve the prevention of the filming over the photoreceptor, thus suppressing the degradation of the image such as density variations, and preventing fogging and other defects.

In the present invention, the content of the aforementioned low molecular weight polypropylene is optimized to thereby improve the dispersion of the wax in the toner compared to conventional ones, thus promoting the anti-filming performance.

Further, the molecular weight of the binder resin and the mixing ratio of the high polymer component and the low molecular weight component are optimized so that the resulting toner can deal with a high speed configuration. Further, this setting also makes it possible to simultaneously improve the fixing performance and reduce the contamination, especially degradation of the developer, and other defects.

The toner for electrophotography of the invention is optimized as to the dispersion of the wax by limiting the dispersion diameter of the wax encapsulated in the binder resin and the dispersion diameter of the wax after the toner production, without optimizing the manufacturing conditions etc., whereby it is possible to prevent filming and setoff.

On the other hand, as to the toner production process, the kneading condition is optimized so as to provide the best mode of a toner which can achieve the retention of a stable image quality, not to mention the elimination of the above problems.

In any case, since the toner contains a proper amount of wax as a separation agent, the toner is of course effective in preventing the occurrence of setoff.

DESCRIPTION OF THE PREFERRED EMBODIMENTS

The essential requirements of the present invention to attain the above objects will become more apparent from the following description of the embodiments of the invention with specific examples.

Now, the mode of the implementation of the invention will be described in detail. First, the developing unit equipped in the image forming apparatus which uses the toner of the invention will be described with reference to FIG. 1.

Figure 1:
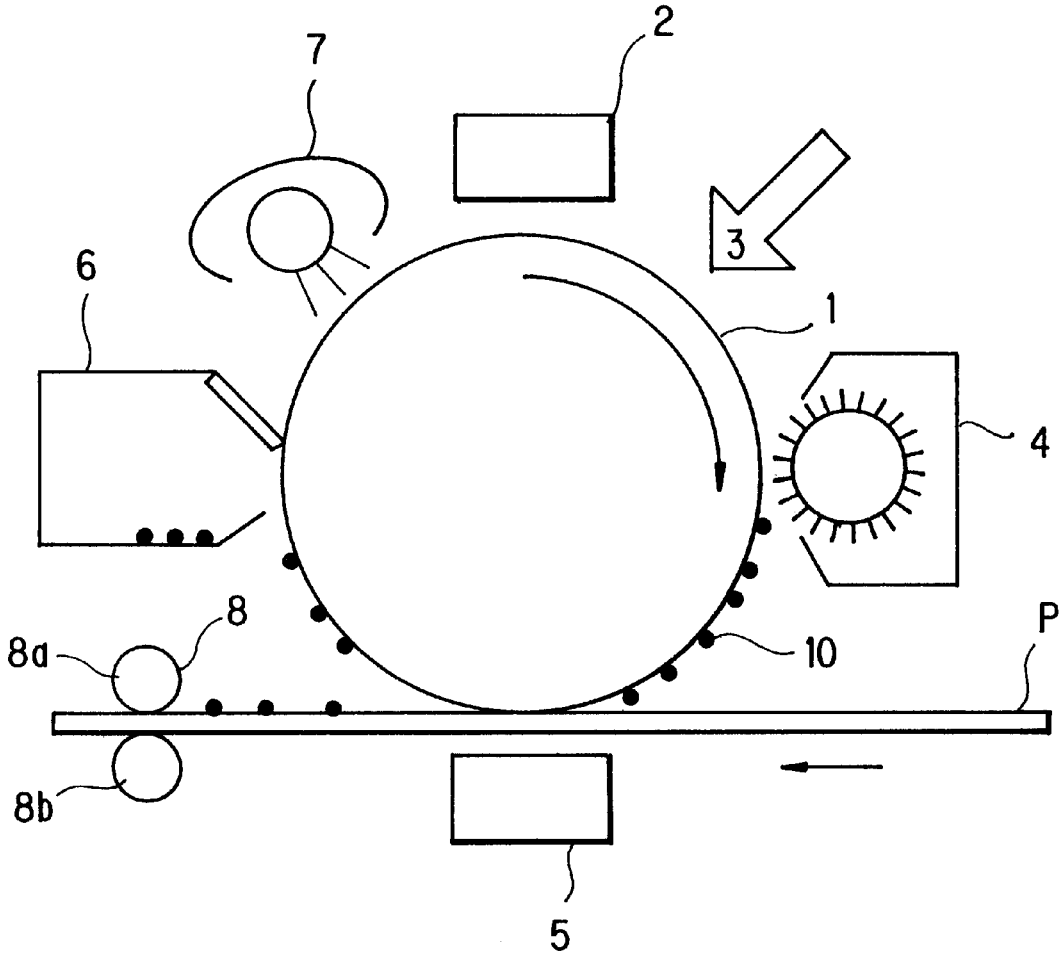
FIG. 1 is a constructional view showing an configurational example of an image forming apparatus using the toner of the invention.

In FIG. 1, the image forming apparatus has a drum-shaped photoreceptor 1 as the image support disposed in the approximate center thereof. This photoreceptor is driven so as to be rotated at a constant speed in the direction indicated by the arrow. The image forming apparatus further includes a plurality of process elements arranged around the photoreceptor to effect image forming. These image forming process elements include: a charger 2 for uniformly charging the photoreceptor 1 surface; an optical image which is obtained from an unillustrated original image by an optical system for exposing the photoreceptor to the optical image; a developing unit 4, which relates to the present invention, for visualizing the static latent image formed on the surface of photoreceptor 1 by illuminating the optical image from the optical system; a transfer/separation charging device 5 for transferring the developed image (toner image) onto a sheet of paper or printing medium which is conveyed as appropriate and for separating the sheet after transfer from photoreceptor 1; a cleaning device 6 for removing the leftover developer (toner) which has not been transferred after transfer and remains on the surface of photoreceptor 1; and a charge erasing device 7 for erasing the charge remaining on the surface of photoreceptor 1. These elements are arranged in this order in the rotational direction of photoreceptor 1.

Aplenty of sheets of paper Pare stacked in, for example, a tray or cassette, although this is not shown, and are fed one by one by a paper feeding means from the stack of paper. The thus fed sheet is delivered into the transfer area between transfer device 5 and photoreceptor 1 so that the leading edge of the paper will correspond to that of the toner image formed on the surface of photoreceptor 1. After this transfer operation, the paper is separated from photoreceptor 1 by the separation charger and then delivered into a fixing unit 8.

The fixing unit fixes the unfixed toner image just transferred on the paper, into a permanent image. The fixing unit comprises a heat roller 8*a* which is disposed so as to be in contact with toner image 10 and a pressing roller 8*b* which presses the paper into close contact with heat roller 8. This heat roller 8*a* is heated to a temperature for fusing and fixing of the toner. Paper P having passed through this fixing unit 8 is discharged from the exterior of the image forming apparatus by means of an unillustrated discharge roller.

The optical system for irradiating the surface of photoreceptor 1 with the aforementioned optical image 3, if it is of a copier, illuminates the original placed on the original table and focuses the reflected light from the original through mirrors and focusing lenses. When the image forming apparatus is a printer or facsimile machine, the aforementioned optical system includes a semiconductor laser which is controlled so as to be switched on and off in accordance with the input image data so as to irradiate the surface of photoreceptor 1 with a beam of light from the laser passing through the optical deflector etc. Thus, the optical system irradiates the surface of photoreceptor 1 with an optical image 3 directly reflected from the original or with an optical image 3 in accordance with the image data so as to form a static latent image on the surface of photoreceptor 1 which has been uniformly charged.

The static latent image thus formed on the surface of photoreceptor 1 is developed by developing unit 4 located opposite photoreceptor 1 as shown in FIG. 1. That is, toner as the developer selectively adheres to the static latent image so as to visualize it with the toner.

Figure 2:
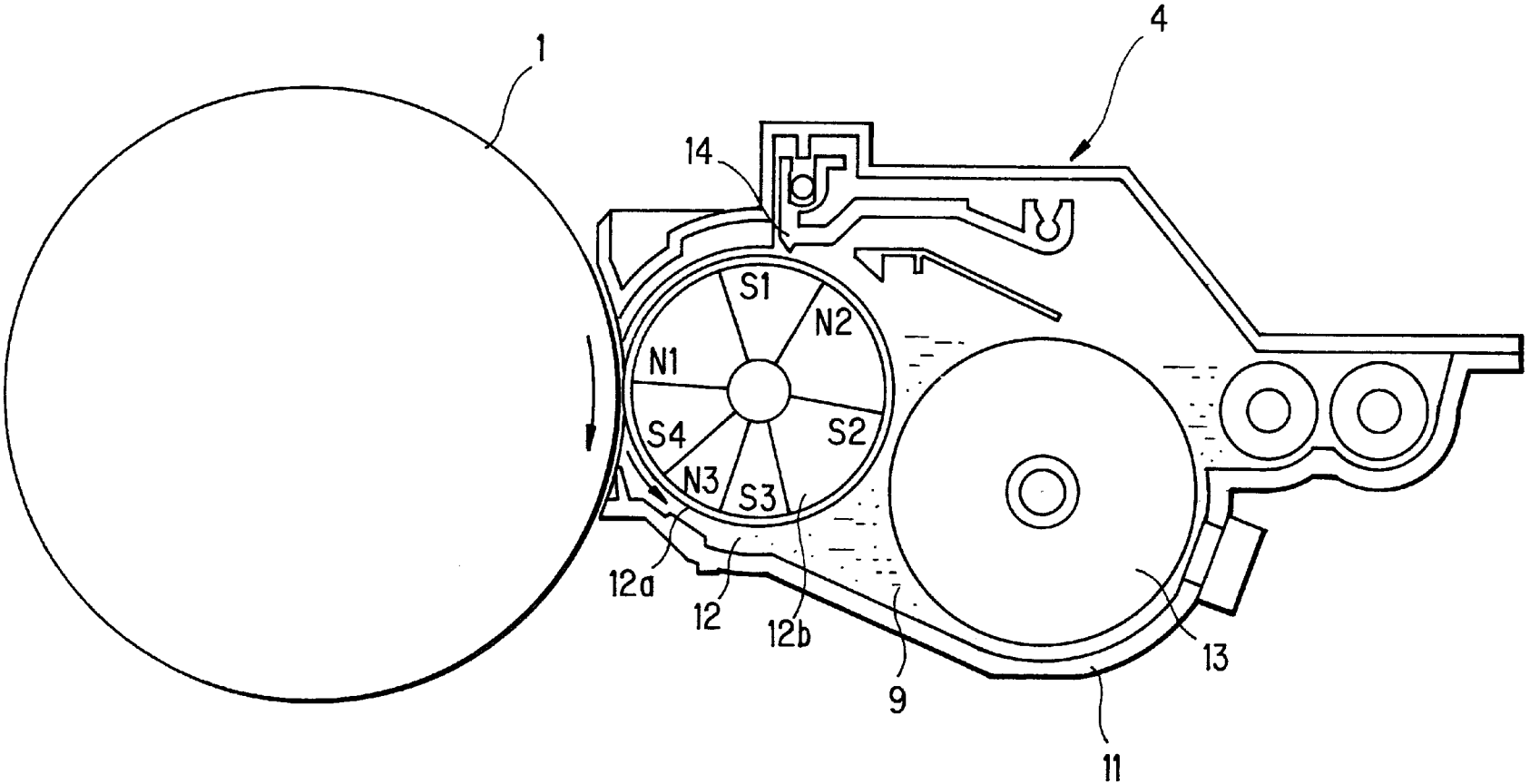
FIG. 2 is a constructional view showing the detail of the developing unit in the image forming apparatus shown in FIG. 1.

This developing unit 4, as configurationally shown in FIG. 2, has in its developing hopper 11 for storing developer 9, a developing roller 12 which is rotatably mounted inside developing hopper 11 and an agitating and conveying means 13 for conveying and/or agitating the developer, and further includes a toner supplying device disposed in the upper part of developing hopper 11 for supplying the toner as required.

Developing roller 12, if it is for a two component developer, or a single component magnetic type toner, has a magnetic roller 12*b* having a multiple number of magnetic poles inside a cylindrical non-magnetic sleeve 12*a*, and attracts the developer by the magnetic force of magnetic roller 12*b* and conveys it when sleeve 12*a* rotates in the direction indicated by the arrow, to the developing area opposing photoreceptor 1. Therefore, developer 9, whilst being attracted to the surface of sleeve 12*a* by the magnetic force of magnetic roller 12*b*, is conveyed by the rotation of sleeve 12*a* so as to be conveyed to the developing area opposing photoreceptor 1. The developer is made to stand up in a brush-like manner or in 'spikes' at the area corresponding to one of the magnetic poles in magnetic roller 12*b* opposing the developing area, the bristle-like developer wipes across the surface of photoreceptor 1, whereby the toner adheres to the static latent image formed on the surface of photoreceptor 1 to effect the development.

Concerning the aforementioned developer 9, in addition to two component developers consisting of toner particles and magnetic carriers and single component developers consisting toner particles which themselves have magnetic properties, developers consisting of non-magnetic single component toner particles are generally known.

The developer attracted to developing roller 12 is cut down before reaching the developing area by a regulating member (doctor) 14 so that the attracted amount of the toner is uniform. More specifically, the regulating member is fixed at its one end to the developing hopper 11 and the other end is positioned with the predetermined clearance (distance) apart from developing roller 12. The developer, whilst passing through the clearance defined by this regulating member, is made uniform as to its amount, whereby a thin layer of developer 9 is formed on the surface of developer roller 12, and is conveyed to the developing area.

Concerning the toner supplying device, a supplying roller for supplying the toner is provided inside the hopper for storing the toner. This supplying roller is composed of a porous material (for example, sponge), and holds the toner in the pores and supplies the toner to the supplying port formed in developing hopper 11.

Provided on the developing hopper 11 side opposing the supplying port is an agitating and conveying means 13, which agitates the supplied toner with developer 9 inside developing hopper 11 and conveys it to developing roller 12.

As stated above, concerning developer 9, other than two component developers consisting of carriers and toner particles and single component developers consisting only of toner particles, there are non-magnetic type single component developers. For a non-magnetic single component developer, since it cannot be attracted by magnetic force to the surface of developing roller 12, the toner is conveyed by using tribo-charging or the like to attract the developer to the surface of developing roller 12. The developing roller 12 in this case is often made up of an elastic material such as rubber etc. Then, regulating member 14 or the like is used to regulate the toner layer attracted to the surface of developing roller 12, so as to form a thin layer having a constant thickness.

Since developer 9 of a single component toner does not need any control of the toner concentration in the developer, no toner supplying device is needed. Therefore, the developer is supplied at a time to developing hopper 11 by means of a toner cartridge etc. On the other hand, if developer hopper 11 needs to be filled up with a certain level of the single component toner, a toner supplying device is provided into which the developer is supplied at a time from the toner cartridge, so that the toner supplying device can supply the toner as necessary.

The 1st Embodiment of the Invention

Now, description will be made hereinbelow of toner compositions constituting developer 9, of the invention, stored in the aforementioned developing unit 4, specifically in developing hopper 11 as well as production methods of toners.

The toner is produced by usually adding a wax in order to provide separation performance to a binder resin, further blending carbon black as a coloring agent, a charge control agent for controlling static charge and the like, and then kneading these materials, followed by crushing and classifying so as to provide toner particles having a prescribed particle size, e.g. about 10 $\mu$m. The thus obtained toner is further mixed with some additives as required to thereby provide externally additive-treated toner as the developer.

For the binder resin, any of the generally known resins may be used. An example is styrene acrylic resin. Styrene acrylic resin is a copolymer composed of styrene as the main component and other vinyl monomers.

The wax component is of polyolefins having a relatively low melting point and having a weight average molecular weight of about 1,000 to 45,000, preferably about 2,000 to 10,000. Specific examples include polyethylene, polypropylene, polybutylene, etc. In accordance with the invention, polypropylene, which is low in molecular weight, is most preferable, and other waxes stated above can be used as required.

When carbon black is used as the coloring agent, the image formed by the toner will be black. When toner of yellow, cyan, magenta or other colors needs to be prepared, a known appropriate coloring agent can be selected as required.

While a charge control agent is added in order to permit the toner to have an appropriate static polarity and an appropriate amount of static charge, this charge control agent may be of a conventional one which is also selected as appropriate in accordance with the required polarity. For example, a quaternary ammonium salt is used in the aftermentioned examples, but this will not limit the invention, and an arbitrary known material can be selected.

As has been stated heretofore, the ingredients for toner, composed of a binder resin, a wax, a coloring agent and a charge control agent are mixed, kneaded, crushed and classified so as to obtain a toner having a prescribed particle size. When this toner is used as the developer, a fluidizer, e.g., silica etc., is added and mixed in order to improve the charge performance and fluidity to thereby provide a usable toner.

The above described toner is used as it is if it is to be used as a single component developer. When this toner is used for a two component developer, the externally additive-treated toner and magnetic carriers are blended to provide a developer.

For the production of a single component developer, in order to provide magnetic properties, the aforementioned ingredients for the toner are further added with a magnetic powder, e.g., magnetic iron oxide, reduced iron oxide etc., and the materials are then mixed, kneaded, crushed and classified to provide a magnetic toner having a prescribed particle size, in the same manner as above. In this magnetic toner, silica etc., is added and mixed in order to improve the fluidity.

In the present invention, in order to prevent the occurrence of the setoff phenomenon that causes the toner to adhere to fixing unit 8, especially heat roller 8*a* etc., a wax having a good separation performance with respect to heat roller 8*a* is made to be contained by the toner. Further, the amount of the wax is correctly regulated so that the wax will not adhere to the photoreceptor or not cause filming.

The binder resin for binding, as the main component of the ingredients for the toner of the invention, is prepared together with a polypropylene wax, having a low molecular weight, encapsulated beforehand or contained in a complex form. Here, 'encapsulation' is effected during the polymerizing stage of a resin. The polymerization means a polymerizing process used for the production of a general binder resin such as solution polymerization, emulsion polymerization, etc. Although the polymerization is not particularly limited, solution polymerization is preferred, and the binder resin used in the invention, e.g., a styrene acrylic resin, is encapsulated with polypropylene as mentioned above.

Since the thus prepared binder with a wax encapsulated beforehand, is used as an ingredient for the toner, it is possible to prevent the phenomenon of filming over the surface of photoreceptor 1 and the phenomenon of setoff to heat roller 8*a* for fixing, which both become problematic in an image forming apparatus which runs at a high speed, specifically 70 sheets per minute or more (in terms of the discharge rate of sheets after image forming from the image forming apparatus).

In order to enhance the above effect, the encapsulated wax such as low molecular weight polypropylene, etc., is dispersed into the resin with its particle diameter equal to 0.3 $\mu$m or below. Then this is further processed, or mixed with appropriate amounts of a coloring agent, charge control agent, etc., and then is kneaded and crushed to provide a toner having a desired particle size. In each toner particle, the diameter of the dispersed wax is controlled so as to be 0.15 $\mu$m or below, whereby it is possible to achieve the above object or solve the problem stated above, and hence maintain the image quality at a beneficial level.

Further, by setting the encapsulated content of the wax in the binder resin, at the range from 0.5 part by weight to 5 parts by weight for 100 parts by weight of the binder resin, it is possible to make the dispersed state of the wax within toner particles more uniform. In particular, when the added amount of the wax is set to fall within the range from 1 part by weight to 2 parts by weight, a further improved effect can be obtained.

On the other hand, high speed image forming apparatuses suffer from the problem in that the toner is fixed to paper P with insufficient strength. More explicitly, because of the high speed processing, paper P supporting a toner image thereon is made to pass through fixing unit 8 in a very short period of time, and hence the fixing process is finished before the toner fuses sufficiently. Resultantly, the toner cannot be fixed firmly onto the paper, so will peel off readily. Further, in this case, the toner tends to adhere to the heat roller, possibly causing the setoff phenomenon. To make matters worse, the high speed operation of developing unit 4, breaks the toner particles into pulverized state whilst agitating means 13 etc., agitates the toner. This not only induces the filming phenomenon but also degrades the fixing performance.

In order to obtain a toner which can eliminate the above drawbacks as well as can prevent occurrence of the above-mentioned setoff and filming phenomena, the physical properties of the binder resin, especially the fracture toughness and the viscosity are enhanced. That is, prevention of breakage of the toner due to agitation inside developing hopper 11, is effective in stabilizing the amount of static charge on the toner and hence preventing the lowering of the image density and the occurrence of fogging. Prevention of toner breaking is also effective in improving the fixing performance while enhancement of the viscosity is effective in improvement of the fixing performance.

Also for these reasons, the binder resin as the main component of the toner, is specified so that the number average molecular weight Mn of the high polymer component of the binder resin which determines the fracture strength is adapted to fall within the range of $1.0\times10^5 \leqq Mn \leqq 2.5\times10^5$ and the number average molecular weight Mn of the low molecular weight component which determines the viscosity is adapted to fall within the range of $2.0\times10^3 \leqq Mn \leqq 3.2\times10^3$. These specifications solve the above problems and prevent the degradation of the image quality, and prevent the filming and setoff phenomena occurring while the fixing performance is kept high.

The effects and advantages of the toner for electrophotography of the invention were confirmed based on the examples shown hereinbelow. These examples also include the cases in which toners to be compared to the toner of the invention were produced and used for image forming.

In order to confirm the effects and advantages of the toner used in the present invention, a SD-4085 copier (a product of Sharp Corporation: a high-speed copier having a copy performance of eighty-five sheets of A4 size paper per minute) was used to evaluate the toner performance based on the image density and fogging. The image density was measured using a MACBETH Densitometer (MACBETH) and fogging was measured using a Z-II OPTICAL SENSOR (NIPPON DENSHOKU INDUSTRIES CO., LTD.). Fogging is represented as the density measurement of white sections (background) in the paper.

The evaluation was made based on the judgment as to the images at the initial stage of copying, after a 50,000 (which will be written as 50K hereinbelow) copy run and a 100,000 (which will be written as 100K hereinbelow) copy run.

The styrene acrylic binder resins used in the aftermentioned examples are listed in Table 1 below, with code numbers. All the binder resins are products of Sanyo Chemical Industries, Ltd.

The wax encapsulated in advance within the binder resin was low molecular weight polypropylene. And the diameter was measured by dissolving the binder resin to be evaluated into tetrahydrofuran (THF), collecting the THF insoluble component using a membrane filter having a mesh diameter of 0.1 μm, and observing the filter using a SEM (S2500) of Hitachi, Ltd. The molecular weight distribution, that is, the number average molecular weight (HpMn) of the high polymer component and the number average molecular weight (LpMn) of the low molecular weight component were measured by an LC6A (SHIMADZU CORPORATION). Further, the 4 mm softening temperature was measured by a CFT-500 (SHIMADZU CORPORATION).

TABLE 1

| No. | Encapsulated Wax Diameter | Encapsulated Amount | HpMn | LpMn | 4 mm Softening Temp. |
|---|---|---|---|---|---|
| A-1 | 0.30 μm | 1 wt. part | $2.5\times10^5$ | $3.2\times10^3$ | 151° C. |
| A-2 | 0.30 μm | 0.5 wt. part | $2.5\times10^5$ | $3.2\times10^3$ | 153° C. |
| A-3 | 0.30 μm | 2 wt. parts | $2.5\times10^5$ | $3.2\times10^3$ | 150° C. |
| A-4 | 0.30 μm | 3 wt. parts | $2.5\times10^5$ | $3.2\times10^3$ | 148° C. |
| A-5 | 0.30 μm | 5 wt. parts | $2.5\times10^5$ | $3.2\times10^3$ | 145° C. |
| A-6 | 0.30 μm | 7 wt. parts | $2.5\times10^5$ | $3.2\times10^3$ | 143° C. |
| B-1 | 1.0 μm | 0.5 wt. part | $2.5\times10^5$ | $3.2\times10^3$ | 153° C. |
| B-2 | 0.5 μm | 2 wt. parts | $2.5\times10^5$ | $3.2\times10^3$ | 150° C. |
| C-1 | 0.30 μm | 1 wt. part | $1.0\times10^5$ | $3.2\times10^3$ | 149° C. |
| C-2 | 0.30 μm | 1 wt. part | $0.9\times10^5$ | $3.2\times10^3$ | 144° C. |
| C-3 | 0.30 μm | 1 wt. part | $3.5\times10^5$ | $3.2\times10^3$ | 156° C. |
| C-4 | 0.30 μm | 1 wt. part | $2.0\times10^5$ | $2.0\times10^3$ | 153° C. |
| C-5 | 0.30 μm | 1 wt. part | $2.0\times10^5$ | $1.5\times10^3$ | 143° C. |
| C-6 | 0.30 μm | 1 wt. part | $2.0\times10^5$ | $5.0\times10^3$ | 157° C. |

EXAMPLE 1

A mixture of ingredients for a toner was prepared as follows: 100 parts by weight of binder resin A-1 in Table 1, 1 part by weight of polyethylene (PE-130: a product of Clariant), 7 parts by weight of carbon (MA100S: a product of MITSUBISHI CHEMICAL CORPORATION) as a coloring agent, 1.5 parts by weight of quaternary ammonium salt (P-51: a product of ORIENT CHEMICAL INDUSTRY CO., LTD.) as a charge control agent were loaded into a mixer (SUPER MIXER: a product of KAWATA CO., LTD.) and mixed therein.

Thereafter, the kneaded mixture was crushed and classified so that a toner having a mean particle size of about 10.0 μm was obtained.

Next, the above-prepared material mixture was loaded into a biaxial kneader (PCM65: a product of IKEGAI Corporation) as a kneader. The kneading cylinder of this kneader was set at a temperature of 150° C. (kneading temperature) so that the mixture was fused and kneaded. In this case, the kneading temperature was set lower by 1° C. than the 4 mm softening temperature of binder resin A-1 (151° C.).

Then, 100 parts by weight of the toner thus obtained from the above production process was loaded into the aforementioned mixer, and 0.1 part by weight of silica powder (R972: a product of NIPPON AEROSIL CO., LTD.) and 0.1 part by weight of magnetite powder (KBC100: a product of Kanto Denka Kogyo Co., Ltd) were externally added thereto and mixed together, thus producing an externally additive-treated toner.

Further, 4 parts by weight of the externally additive-treated toner and 100 parts by weight of ferrite carriers made up of ferrite cores coated with a silicone resin were loaded into, a mixer, specifically, Nauta mixer (a product of Hosokawa Micron Corporation) and agitated and mixed thus producing a two component developer.

The diameter of the dispersed wax in the thus obtained toner particles was measured in the same manner as in the above-described measurement of the diameter of the dispersed particles within the binder resin. As a result, the diameter was 0.14 μm.

With a correct amount of the thus obtained two component developer supplied to the developing hopper, a 100K sheet actual copy run was performed in SD-4085 copier whilst the externally additive-treated toner as the supplement toner was being supplied as required. This actual copy run was performed in a 25° C., RH 60% atmosphere.

The resulting copies were stable in image density from the initial copy up to 100K, and good image quality could be maintained, without fogging as well as free of filming over the photoreceptor surface.

EXAMPLE 2

In the same manner as in example 1, a toner was produced by using binder resin A-2 in place of binder resin A-1 used in example 1, kneading at a temperature of 150° C., which was set lower by 3° C. than the 4 mm softening temperature of binder resin A-2 (153° C.). The thus obtained toner was treated with external additives and then blended with carriers, thus producing an externally additive-treated toner and a developer. The diameter of the dispersed wax within the thus obtained toner particles was 0.15 μm.

The result of an actual copy run was almost as good as that of example 1.

EXAMPLE 3

In the same manner as in example 1, a toner was produced by using binder resin A-3 in place of binder resin A-1 used in example 1, kneading at a temperature of 150° C., which was set equal to the 4 mm softening temperature of binder resin A-3 (150° C.). The thus obtained toner was treated with external additives and then blended with carriers, thus producing an externally additive-treated toner and a developer. The diameter of the dispersed wax within the thus obtained toner particles was 0.18 μm.

The result of an actual copy run was almost as good as that of example 1.

EXAMPLE 4

In the same manner as in example 1, a toner was produced by using binder resin A-4 in place of binder resin A-1 used in example 1, kneading at a temperature of 150° C., which was set higher by 2° C. than the 4 mm softening temperature of binder resin A-4 (148° C.). The thus obtained toner was treated with external additives and then blended with carriers, thus producing an externally additive-treated toner and a developer. The diameter of the dispersed wax within the thus obtained toner particles was 0.22 μm.

From the actual copy results after a 100K run, the image density in normal mode (N mode) and that in photographic mode (P mode) tended to make little difference. A slight rise in fogging was observed but the level was allowable in practical usage. No filming over the photoreceptor was found.

Here, normal and photo modes are made different by changing the voltage to be applied when the photoreceptor is charged. In this case, a scorotron type charger was used to uniformly charge the photoreceptor. When, in N mode, −650 V was applied to the grid of the charger whereas −440 V was applied to the grid in P mode, to charge the photoreceptor to the respective potential. The conditions of the thus obtained image, that is, the density of the toner image and fogging were measured for evaluation.

EXAMPLE 5

In the same manner as in example 1, a toner was produced by using binder resin A-5 in place of binder resin A-1 used in example 1, kneading at a temperature of 150° C., which was set higher by 50° C. than the 4 mm softening temperature of binder resin A-5 (145° C.). The thus obtained toner was treated with external additives and then blended with carriers, thus producing an externally additive-treated toner and a developer. The diameter of the dispersed wax within the thus obtained toner particles was 0.23 μm.

The result of an actual copy run was almost as good as that of example 4.

EXAMPLE 6

Comparative Example 1

In the same manner as in example 1, a toner was produced by using binder resin A-6 in place of binder resin A-1 used in example 1, kneading at a temperature of 150° C., which was set higher by 7° C. than the 4 mm softening temperature of binder resin A-6 (143° C.). The thus obtained toner was treated with external additives and then blended with carriers, thus producing an externally additive-treated toner and a developer. The diameter of the dispersed wax within the thus obtained toner particles was 0.25 μm.

The evaluation result of an actual copy run was as follows: In the initial stage, the image was of an allowable level, but after a 50K run, the image density in N mode and that in P mode became little different, and after a 100K run, the image density was extremely lowered. As to fogging, rather dense fog appeared after a 50K run and the image after a 100K run was degraded to a level which causes practical problems. Further, filming of a substance believed to be wax was recognized over the photoreceptor surface. It is believed that this filming deteriorated the functions, especially the characteristics of the photoreceptor, having a great influence on density and fogging.

EXAMPLE 7

Comparative Example 2

In the same manner as in example 1, a toner was produced by using binder resin B-1 in place of binder resin A-1 used in example 1, kneading at a temperature of 140° C., which was set lower by 13° C. than the 4 mm softening temperature of binder resin B-1 (153° C.). The thus obtained toner was treated with external additives and then blended with carriers, thus producing an externally additive-treated toner and a developer. The diameter of the dispersed wax within the thus obtained toner particles was 0.75 μm.

The evaluation result of an actual copy run was as follows: After a 50K run, filming arose on the photoreceptor surface, so that the image density tended to be markedly lowered. After a 100K run, filming on the photoreceptor surface became worse so that the image density was further lowered. Except in the initial stage, the level of fogging was high causing practical problems,

EXAMPLE 8

Comparative Example 3

In the same manner as in example 1, a toner was produced by using binder resin B-2 in place of binder resin A-1 used in example 1, kneading at a temperature of 140° C., which was set lower by 10° C. than the 4 mm softening temperature of binder resin B-2 (150° C.). The thus obtained toner was treated with external additives and then blended with carriers, thus producing an externally additive-treated toner and a developer. The diameter of the dispersed wax within the thus obtained toner particles was 0.45 μm.

The evaluation result of an actual copy run while almost being the same as that of example 7 (comparative example 2) was somewhat improved.

EXAMPLE 9

In the same manner as in example 1, a toner was produced by using binder resin C-1 in place of binder resin A-1 used in example 1, kneading at a temperature of 150° C., which was set higher by 1° C. than the 4 mm softening temperature of binder resin C-1 (149° C.). The thus obtained toner was treated with external additives and then blended with carriers, thus producing an externally additive-treated toner and a developer. The diameter of the dispersed wax within the thus obtained toner particles was 0.20 μm.

The actual copy run operation provided images as stable as that of example 1.

EXAMPLE 10

Comparative Example 4

In the same manner as in example 1, a toner was produced by using binder resin C-2 in place of binder resin A-1 used in example 1, kneading at a temperature of 150° C., which was set higher by 6° C. than the 4 mm softening temperature of binder resin C-2 (144° C.). The thus obtained toner was treated with external additives and then blended with carriers, thus producing an externally additive-treated toner and a developer. The diameter of the dispersed wax within the thus obtained toner particles was 0.20 μm.

The evaluation result of an actual copy run was as follows: In the initial stage, the image was not particularly bad, but after a 50K run, the image density in photo mode increased so that the images in N mode and in P mode produced little difference while fogging increased, producing a considerably bad image.

Black clumps due to transfer failure, though few, were recognized in the black solid areas in the image. In order to check the cause, the developer in the developing hopper was examined. As a result, toner clumps though they were few, were found. From checking using a magnet, the carrier was found to exist inside the clumps. This phenomenon is believed to be attributed to the fact that the HpMn of the high polymer component of the binder resin is low as understood from Table 1. More specifically, it is believed that, because of the lowness of the HpMn, the toner had an insufficiency in mechanical strength so that the toner particles were pulverized during the agitation inside the developing hopper, and these over-pulverized toner particles increased cohesion therebetween, forming clumps.

EXAMPLE 11

Comparative Example 5

In the same manner as in example 1, a toner was produced by using binder resin C-3 in place of binder resin A-1 used in example 1, kneading at a temperature of 150° C., which was set lower by 6° C. than the 4 mm softening temperature of binder resin C-3 (156° C.). The thus obtained toner was treated with external additives and then blended with carriers, thus producing an externally additive-treated toner and a developer. The diameter of the dispersed wax within the thus obtained toner particles was 0.29 μm.

The evaluation result of an actual copy run exhibited a low image density from the initial stage, and no signs of recovery. Fogging was not bad or kept within allowable limits.

This result can be considered to stem from the fact that Mn of the high polymer component of the binder resin was very high and hence sufficient uniformity could not be achieved during the production process of the toner, in particular, at the kneading step.

EXAMPLE 12

In the same manner as in example 1, a toner was produced by using binder resin C-4 in place of binder resin A-1 used in example 1, kneading at a temperature of 150° C., which was set lower by 3° C. than the 4 mm softening temperature of binder resin C-4 (153° C.). The thus obtained toner was treated with external additives and then blended with carriers, thus producing an externally additive-treated toner and a developer. The diameter of the dispersed wax within the thus obtained toner particles was 0.13 μm.

The resulting copies for evaluation were continuously stable in the image density, and good image quality could be maintained, free of fogging with no filming over the photoreceptor surface.

EXAMPLE 13

Comparative Example 6

In the same manner as in example 1, a toner was produced by using binder resin C-5 in place of binder resin A-1 used in example 1, kneading at a temperature of 150° C., which was set higher by 7° C. than the 4 mm softening temperature of binder resin C-5 (143° C.). The thus obtained toner was treated with external additives and then blended with carriers, thus producing an externally additive-treated toner and a developer. The diameter of the dispersed wax within the thus obtained toner particles was 0.21 μm.

The evaluation result of an actual copy run was as follows: Other than at the initial stage, the image density and the level of fogging were high, and the quality of the image was not good. After a 100K run, the amount of static charge on the toner was measured by a blow-off charge meter, of Toshiba Chemical Corp. The amount of static charge of the toner was 12 μC/g, divergent from the proper static charge range (16 to 18 μC/g).

This degradation is considered to stem from a similar cause to that of example 10 (comparative example 4). That is, toner particles conceivably adhered to the carrier surface whereby the charge performance of the carrier was inhibited.

In actual fact, when the developer in the developing hopper was checked, it was observed that the toner particles had stuck to the surface of the carrier, forming clumps locally. It can be believed that the occurrence of such a phenomenon inhibited the mechanism (function) of tribocharging between the carrier and toner, lowering the charge performance, and hence causing the image defects. The cause of this occurrence can be attributed to the fact that the binder resin in question was low in the LpMn of the low molecular weight component and hence was high in viscosity. That is, it is believed that, as the temperature inside the developing hopper and the machine interior increased during the copying operation, the toner became softened causing the aforementioned phenomenon.

EXAMPLE 14

Comparative Example 7

In the same manner as in example 1, a toner was produced by using binder resin C-6 in place of binder resin A-1 used in example 1, kneading at a temperature of 150° C., which was set lower by 7° C. than the 4 mm softening temperature of binder resin C-6 (157° C.). The thus obtained toner was treated with external additives and then blended with carriers, thus producing an externally additive-treated toner and a developer. The diameter of the dispersed wax within the thus obtained toner particles was 0.23 μm.

The evaluation result of an actual copy run exhibited a poor fixing performance of the toner to the paper from the initial stage so that the toner in the image area peeled off when the toner image area was touched by hands, producing practical usage difficulties.

This can be conceivably attributed to the fact that the binder resin was high in the LpMn of the low molecular weight component, and hence could not provide sufficient fixing strength to the paper.

EXAMPLE 15

A toner was produced in the same manner as in example 1, except in that the kneading temperature was set at 155° C., which was higher by 4° C. than the 4 mm softening temperature of binder resin A-1 (151° C.). The thus obtained toner was treated with external additives and then blended with carriers, thus producing an externally additive-treated toner and a developer. The diameter of the dispersed wax within the thus obtained toner particles was 0.19 μm.

The result of an actual copy run was almost as good as that of example 1.

EXAMPLE 16

Comparative Example 8

A toner was produced in the same manner as in example 1, except in that the kneading temperature was set at 160° C., which was higher by 9° C. than the 4 mm softening temperature of binder resin A-1 (151° C.). The thus obtained toner was treated with external additives and then blended with carriers, thus producing an externally additive-treated toner and a developer. The diameter of the dispersed wax within the thus obtained toner particles was 0.20 μm.

The evaluation result of an actual copy run was as follows: In the initial stage, the image was stable as to image density and fogging so was not particularly bad. After a 50K run, however, the image density tended to be lowered.

The cause can be conceivably attributed to that fact that the binder resin was kneaded at a temperature 9° C. higher than the 4 mm softening temperature thereof, and hence the viscosity in the kneader was lowered so that the dispersion conditions of the coloring agent and the charge control agent were varied whereby the amount of static charge, which would affect the image density, was lowered.

EXAMPLE 17

Comparative Example 9

A toner was produced in the same manner as in example 1, except in that the kneading temperature was set at 142° C., which was lower by 9° C. than the 4 mm softening temperature of binder resin A-1 (151° C.). The thus obtained toner was treated with external additives and then blended with carriers, thus producing an externally additive-treated toner and a developer. The diameter of the dispersed wax within the thus obtained toner particles was 0.17 μm.

The evaluation result of an actual copy run was as follows: In the initial stage, the image was stable as to image density and fogging and so was not particularly bad. After a 50K run, however, the image density tended to be lowered.

The cause can be conceivably attributed to that fact that the binder resin was kneaded at a temperature 9° C. lower than the 4 mm softening temperature thereof, and hence the torque inside the kneader increased and an excessive kneading shear arose so that the dispersion conditions of the coloring agent and the charge control agent were varied whereby the amount of static charge, which would affect the image density, was lowered.

EXAMPLE 18

Comparative Example 10

A toner was produced in the same manner as in example 7 (comparative example 2), except in that the kneading temperature was set at 150° C., which was lower by 3° C. than the 4 mm softening temperature of binder resin B-1 (153° C.). The thus obtained toner was treated, in a similar manner to example 1, with external additives and then blended with carriers, thus producing an externally additive-treated toner and a developer. The diameter of the dispersed wax within the thus obtained toner particles was 0.54 μm.

The result of an actual copy run exhibited occurrence of filming although the degree of filming was lower than that occurring in example 7 (comparative example 2). The other evaluation items relating to the image were improved slightly compared to those of example 7 (comparative example 2).

Here, although the same binder resin as that in example 7 (comparative example 2) was used, it is conceivable that the kneading conditions in the toner production process were optimized and hence the dispersion conditions of the materials could be improved so that the resultant toner could have a stable charge performance.

EXAMPLE 19

Comparative Example 11

A toner was produced in the same manner as in example 8 (comparative example 3), except in that the kneading temperature was set at 150° C., which was equal to the 4 mm softening temperature of binder resin B-2 (150° C.). The thus obtained toner was treated, in a similar manner to example 1, with external additives and then blended with carriers, thus producing an externally additive-treated toner and a developer. The diameter of the dispersed wax within the thus obtained toner particles was 0.30 μm.

The result of an actual copy run exhibited occurrence of filming although the degree of filming was lower than that occurring in example 8 (comparative example 3). The other evaluation items relating to the image were improved significantly compared to those of example 8 (comparative example 3).

Here, although the same binder resin as that in example 8 (comparative example 3) was used, it is conceivable that the kneading conditions in the toner production process were optimized and hence the dispersion conditions of the materials could be improved so that the resultant toner could have a stable charge performance.

The evaluation results of examples 1 to 19 are summarized in Table 2 for reference. To explain the judgment in Table 2, "O" implies a case where no filming over the photoreceptor surface occurred and a good image was obtained which was normal in the image density and free from fogging. "X" implies a case where at least one of the three evaluation items, 'image density', 'fogging' and 'filming', failed to meet the satisfactory level.

Concerning the problem of fixing performance, the molecular weight of the binder resin is optimized based on the comparison of examples 12, 13 and 14. When the LpMn

TABLE 2

| | Image Density | | | | | | Fogging | | | | | | | |
|---|---|---|---|---|---|---|---|---|---|---|---|---|---|---|
| | Initial Stage | | 50K | | 100K | | Initial Stage | | 50K | | 100K | | | |
| Example | N mode | P mode | N mode | P mode | N mode | P mode | N mode | P mode | N mode | P mode | N mode | P mode | Filming | Judgment |
| 1 | 1.41 | 1.15 | 1.39 | 1.14 | 1.39 | 1.15 | 0.32 | 0.40 | 0.30 | 0.35 | 0.31 | 0.34 | None | ○ |
| 2 | 1.42 | 1.13 | 1.41 | 1.13 | 1.39 | 1.11 | 0.33 | 0.41 | 0.31 | 0.37 | 0.32 | 0.35 | None | ○ |
| 3 | 1.41 | 1.16 | 1.41 | 1.15 | 1.40 | 1.16 | 0.34 | 0.40 | 0.33 | 0.38 | 0.35 | 0.38 | None | ○ |
| 4 | 1.41 | 1.16 | 1.38 | 1.17 | 1.35 | 1.20 | 0.35 | 0.42 | 0.39 | 0.48 | 0.47 | 0.58 | None | ○ |
| 5 | 1.40 | 1.17 | 1.37 | 1.18 | 1.36 | 1.22 | 0.34 | 0.39 | 0.41 | 0.49 | 0.52 | 0.59 | None | ○ |
| 6 | 1.41 | 1.15 | 1.36 | 1.20 | 1.21 | 1.00 | 0.36 | 0.42 | 1.21 | 1.32 | 1.45 | 1.63 | Found | X |
| 7 | 1.40 | 1.12 | 1.31 | 1.00 | 1.20 | 0.95 | 0.39 | 0.48 | 1.33 | 1.48 | 1.79 | 1.83 | Found | X |
| 8 | 1.39 | 1.13 | 1.29 | 1.05 | 1.21 | 0.97 | 0.40 | 0.42 | 1.38 | 1.44 | 1.76 | 1.87 | Found | X |
| 9 | 1.40 | 1.12 | 1.38 | 1.13 | 1.39 | 1.12 | 0.31 | 0.39 | 0.32 | 0.34 | 0.33 | 0.39 | None | ○ |
| 10 | 1.38 | 1.13 | 1.31 | 1.21 | 1.32 | 1.22 | 0.33 | 0.37 | 0.79 | 0.85 | 1.32 | 1.43 | None | X |
| 11 | 1.31 | 1.00 | 1.29 | 0.95 | 1.30 | 0.90 | 0.39 | 0.41 | 0.40 | 0.42 | 0.43 | 0.47 | None | X |
| 12 | 1.40 | 1.13 | 1.39 | 1.13 | 1.39 | 1.14 | 0.32 | 0.33 | 0.31 | 0.33 | 0.35 | 0.39 | None | ○ |
| 13 | 1.40 | 1.14 | 1.42 | 1.29 | 1.43 | 1.28 | 0.37 | 0.41 | 0.79 | 0.91 | 1.54 | 1.08 | None | X |
| 14 | 1.39 | 1.15 | 1.34 | 1.01 | 1.32 | 1.00 | 0.36 | 0.40 | 0.41 | 0.43 | 0.47 | 0.52 | None | X |
| 15 | 1.41 | 1.10 | 1.39 | 1.11 | 1.38 | 1.13 | 0.35 | 0.41 | 0.32 | 0.39 | 0.33 | 0.39 | None | ○ |
| 16 | 1.38 | 1.12 | 1.31 | 1.01 | 1.27 | 0.93 | 0.35 | 0.43 | 0.41 | 0.43 | 0.40 | 0.45 | None | X |
| 17 | 1.39 | 1.13 | 1.29 | 0.98 | 1.26 | 0.90 | 0.33 | 0.41 | 0.38 | 0.44 | 0.41 | 0.48 | None | X |
| 18 | 1.39 | 1.12 | 1.34 | 1.07 | 1.30 | 1.00 | 0.40 | 0.43 | 0.85 | 0.97 | 1.35 | 1.43 | Found | X |
| 19 | 1.39 | 1.13 | 1.33 | 1.08 | 1.31 | 1.01 | 0.39 | 0.39 | 0.77 | 0.90 | 1.19 | 1.28 | Found | X |

As understood from Table 2, prevention of the filming phenomenon over the photoreceptor can be achieved if the content of the wax, i.e., the dispersed diameter of the wax (polypropylene) encapsulated within the binder resin is 0.3 $\mu$m or less.

As understood from example 6 (comparative example 1), filming readily occurs when a greater amount of wax is encapsulated to the binder resin, so that it is preferred that the content of the wax is at most five parts by weight or less in order to more efficiently prevent the evolution of filming. On the other hand, if this content is too small, the setoff problem of the fixing roller in the fixing unit, namely the heat roller which comes into contact with the toner image, appears. Therefore, 0.5 or more parts by weight of the wax need to be added.

The problem of fogging can be eliminated when the aforementioned filming problem over the photoreceptor is solved. Therefore, in order to obtain stable image quality, the added amount and the dispersed diameter of the wax need to be optimized.

Even when the photoreceptor filming problem was solved, fogging will also increase in level by over-pulverizing of the toner, which stems from the mechanical strength problem of the toner itself. Therefore, it is preferred that the molecular weight distribution of the binder resin is optimized. For example, from the comparison of examples 9, 10 and 11, it is found that when the HpMn (the number average molecular weight) of the high polymer component of the binder resin is lower than $1.0\times10^5$ (the case of example 10), the toner's mechanical strength is low causing fogging stemming from over-pulverizing. When the HpMn exceeds $2.5\times10^5$ (the case in example 11), the problem of mechanical strength can be solved but the image density cannot be kept high enough due to poor kneading, resulting in image degradation. Accordingly, the molecular weight of high polymer component of the binder resin is preferably set in the range of $1.0\times10^5$ to $2.5\times10^5$.

of the low molecular weight component is lower than $2.0\times10^3$ (the case of example 13), the softening of the toner itself produces difficulties, causing a rise in fogging due to insufficiency of static charge. On the other hand, if the LpMn exceeds $3.2\times10^3$, the problem of fogging can be solved but fixing failure occurs from the problem of viscosity. Therefore, selection of a binder resin of which the LpMn of the low molecular weight component falls within the range of $2.0\times10^3$ to $3.2\times10^3$ produces a beneficent result.

Further, for stabilization of the toner characteristics, the production process of the toner, in particular, the kneading step is the important factor. That is, the kneading step has great influence on the dispersed states of the wax, coloring agent and charge control agent contained in the toner. Accordingly, the temperature during kneading is important, which can be understood from the comparison of examples 1, 15 through 17.

Illustratively, suppose that the 4 mm softening temperature of the binder resin is MOC. When the kneading temperature is set at a temperature beyond the range of M±5° C., the image density is found to be degraded due to the variations of the characteristics of the toner produced (examples 16 and 17).

When the kneading temperature of the kneading step in the toner production process, is set within the range of M±5° C. (M: the 4 mm softening temperature of the binder resin), even if the wax particles which have been encapsulated beforehand in the binder resin are 0.3 $\mu$m or more in diameter, the dispersed diameter of the wax tends to become smaller, so that the problems of filming and fogging etc., are improved.

For example, from the comparisons between examples 7 and 18 and between examples 8 and 19, significant improvement was found as to fogging and image density. Therefore, when the kneading temperature is set at the range of M±5° C. (M is the 4 mm softening temperature of the binder resin), it is possible to produce a specified toner having stable performance as well as to prevent filming over the photoreceptor or other problems.

The 2nd Embodiment of the Invention

In the second embodiment, the diameter of the dispersed wax encapsulated in the binder resin, which is the main component in the production of the toner, and the diameter of the wax dispersed in the toner after the production, are optimized to provide a toner for electrophotography with which setoff and filming can be prevented.

This optimization makes the dispersed state of the wax better and hence prevents the problems of filming and setoff even when the conditions of manufacturing the toner, etc., are not optimized.

In this embodiment, the coloring agent as a constituent of the toner ingredients and the molecular weight of the binder resin are specified so as to provide a toner for electrophotography which presents good fixing performance and good preservability.

The toner for the electrophotography of the invention is the same as described in the first embodiment, and this toner is produced by adding a wax in order to provide separation performance, to a binder resin, further blending of carbon black as a coloring agent, a charge control agent for controlling static charge and the like, and then kneading these ingredients, followed by crushing and classifying so as to provide toner particles having a prescribed particle size, e.g. about 10 $\mu$m. The thus obtained toner is further mixed with some additives as required to thereby provide externally additive-treated toner as the developer.

The binder resin may use any of the generally known resins. An example is styrene acrylic resin. Styrene acrylic resin is a copolymer composed of styrene as the main component and other vinyl monomers.

The wax component used in this embodiment is of polyolefins having a relatively low melting point and having a weight average molecular weight of about 1,000 to 45,000, preferably about 6,000 to 8,000. Specific examples include polyethylene, polypropylene, polybutylene, etc. In accordance with the invention, polypropylene, which is low in molecular weight, is most preferable, and other waxes stated above can be used as required.

When carbon black is used as the coloring agent, the image formed by the toner will be black. When toner of yellow, cyan, magenta or other colors needs to be prepared, a known appropriate coloring agent can be selected as required.

While a charge control agent is added in order to permit the toner to have an appropriate static polarity and an appropriate amount of static charge, this charge control agent may be of a conventional one which is also selected as appropriate in accordance with the required polarity. For example, a quaternary ammonium salt is used in the aftermentioned examples, but this will not limit the invention, and an arbitrary known material can be selected.

As has been stated heretofore, the toner ingredients for toner, composed of a binder resin, a wax, a coloring agent and a charge control agent is mixed, kneaded, crushed and classified so as to obtain a toner having a prescribed particle size. When this toner is used as the developer, a fluidizer, e.g., silica etc., is added and mixed in order to improve the charge performance and fluidity to thereby provide a usable toner.

The above described toner is used as it is if it is to be used as a single component developer. When this toner is used for a two component developer, the externally additive-treated toner and magnetic carriers are blended to provide a developer.

For the production of a single component developer, in order to provide magnetic properties, the aforementioned ingredients for the toner are further added with a magnetic powder, e.g., magnetic iron oxide, reduced iron oxide etc., and the ingredients are then mixed, kneaded, crushed and classified to provide a magnetic toner having a prescribed particle size, in the same manner as above. In this magnetic toner, silica etc., is added and mixed in order to improve the fluidity.

In the second embodiment of the present invention, in order to prevent the occurrence of the setoff phenomenon that causes the toner to adhere to fixing unit 8, especially heat roller 8*a* etc., a wax having a good separation performance with respect to heat roller 8*a* is made to be contained by the toner. Further, the wax diameter is correctly regulated so that the wax will not adhere to the photoreceptor or not cause filming. In particular, the diameter of the wax contained within binder resin is correctly regulated so that the wax can be dispersed successfully even if the conditions in the production process are not optimized and hence filming and setoff will be prevented.

The binder resin for binding, as the main component of the ingredients for the toner of the invention, is prepared together with a polypropylene wax, having a low molecular weight, encapsulated before hand or contained in a complex form. Here, 'encapsulation' is effected during the polymerizing stage of a resin. The polymerization means a polymerizing process used for the production of a general binder resin such as solution polymerization, emulsion polymerization, etc. Although the polymerization is not particularly limited, solution polymerization is preferred, and the binder resin used in the invention, e.g., a styrene acrylic resin, is encapsulated with polypropylene as mentioned above.

Since the thus prepared binder with a wax encapsulated beforehand, is used as an ingredient for the toner, it is possible to prevent the phenomenon of filming over the surface of photoreceptor 1 and the phenomenon of setoff to heat roller 8*a* for fixing, which both become problematic in an image forming apparatus which runs at a high speed, specifically 70 sheets per minute or more (in terms of the discharge rate of sheets after image forming from the image forming apparatus).

In order to enhance the above effect, the encapsulated wax such as low molecular weight polypropylene, etc., is dispersed into the resin with its particle diameter, especially domain diameter equal to 3.0 $\mu$m or below. Then this is further processed, or mixed with appropriate amounts of a coloring agent, charge control agent, etc., and then is kneaded and crushed to provide a toner having a desired particle size. In each toner particle, the domain diameter of the dispersed wax is set at 1.0 $\mu$m or below and 0.1 $\mu$m or above. This setting makes it is possible to achieve the above object or solve the problem stated above, enabling maintenance of the image quality at an improved level.

Further, by setting the encapsulated content of the wax in the binder resin, at the range from 0.1 part by weight to not more than 5 parts by weight for 100 parts by weight of the binder resin, it is possible to make the dispersed state of the wax within toner particles more uniform. In particular, when the added amount of the wax is set to fall within the range from 1 part by weight to 2 parts by weight, a further improved effect can be obtained.

On the other hand, high speed image forming apparatuses suffer from the problem in that the toner is fixed to paper P with insufficient strength. More explicitly, because of the high speed processing, paper P supporting a toner image thereon is made to pass through fixing unit 8 in a very short period of time, and hence the fixing process is finished before the toner fuses sufficiently. Resultantly, the toner cannot be fixed firmly onto the paper, so will peel off readily. Further, in this case, the toner tends to adhere to the heat roller, possibly causing the setoff phenomenon. To make matters worse, the high speed operation of developing unit 4, breaks the toner particles pulverized whilst agitating means 13 etc., agitates the toner. This not only induces the filming phenomenon but also degrades the fixing performance.

In order to obtain a toner which can eliminate the above drawbacks as well as can prevent occurrence of the above-mentioned setoff and filming phenomena, the physical properties of the binder resin, especially the fracture toughness and the viscosity are enhanced. That is, prevention of breakage of the toner due to agitation inside developing hopper 11, is effective in stabilizing the amount of static charge on the toner and hence preventing the lowering of the image density and the occurrence of fogging. Prevention of toner breaking is also effective in improving the fixing performance while enhancement of the viscosity is effective in improvement of the fixing performance.

Also for these reasons, the binder resin as the main component of the toner, is specified so that the number average molecular weight Mn of the high polymer component of the binder resin which determines the fracture strength is adapted to fall within the range of $1.0\times10^5 \leqq Mn \leqq 2.5\times10^5$ and the number average molecular weight Mn of the low molecular weight component which determines the viscosity is adapted to fall within the range of $2.0\times10^3 \leqq Mn \leqq 3.2\times10^3$. These specifications solve the above problems and prevent the degradation of the image quality, and prevent the filming and setoff phenomena occurring while the fixing performance is kept high.

The effects and advantages of the toner for electrophotography of the second embodiment of the invention were confirmed based on the examples shown hereinbelow.

In order to confirm the effects and advantages of the toner used in the present invention, a SD-4085 copier (a product of Sharp Corporation: a high-speed copier having a copy performance of eighty-five sheets of A4 size paper per minute) was used to evaluate the toner performance based on the image density and fogging. The image density was measured using a MACBETH Densitometer (MACBETH) and fogging was measured using a Z-II OPTICAL SENSOR (NIPPON DENSHOKU INDUSTRIES CO., LTD.). Fogging is represented as the density measurement of white sections (background) in the paper.

The evaluation was made based on the judgment of the images at the initial stage of copying and after a 100,000 (which will be written as 100K hereinbelow) copy run. The anti-filming performance, the fixing performance, the anti-aging performance, the anti-setoff performance were judged from visual observation and classified into three levels.

The styrene acrylic binder resins used in the aftermentioned examples, the encapsulated domain diameter of polypropylene contained in the binder resin and the domain diameter after toner production are listed in Table 3 below. All the binder resins are products of Sanyo Chemical Industries, Ltd.

TABLE 3

| | Binder Resin (100 parts by weight) | | | | | | Wax | | | | |
|---|---|---|---|---|---|---|---|---|---|---|---|
| Example | HpMn ($\times 10^5$) | LpMn ($\times 10^3$) | Prev. Elasticity 1 (N/cm$^2$) (° C.) | Melt Viscosity 1000 Pa · s (° C.) | Loss Elasticity 140° C. (N/cm$^2$) | Glass-transition temp. (° C.) | Amount of Encapsulated Wax (parts) | Domain Disameter in Resin ($\mu$m) | Domain Diameter in Toner | Mn ($\times 10^3$) | Softening Point (° C.) |
| 21 | 1.75 | 2.6 | 186 | 122 | 3.8 | 65 | 1.0 | 2.0 | 0.3 | 7.0 | 152 |
| 22 | 1.75 | 2.6 | 186 | 122 | 3.8 | 65 | 1.0 | 6.0 | 2.0 | 7.0 | 152 |
| 23 | 1.75 | 2.6 | 186 | 122 | 3.8 | 65 | 1.0 | 0.8 | 0.05 | 7.0 | 152 |
| 24 | 0.8 | 1.5 | 186 | 122 | 3.8 | 65 | 1.0 | 2.0 | 0.3 | 7.0 | 152 |
| 25 | 3.0 | 3.5 | 186 | 122 | 3.8 | 65 | 1.0 | 2.0 | 0.3 | 7.0 | 152 |
| 26 | 1.75 | 2.6 | 150 | 122 | 3.8 | 65 | 1.0 | 2.0 | 0.3 | 7.0 | 152 |
| 27 | 1.75 | 2.6 | 220 | 122 | 3.8 | 65 | 1.0 | 2.0 | 0.3 | 7.0 | 152 |
| 28 | 1.75 | 2.6 | 186 | 110 | 3.8 | 65 | 1.0 | 2.0 | 0.3 | 7.0 | 152 |
| 29 | 1.75 | 2.6 | 186 | 140 | 3.8 | 65 | 1.0 | 2.0 | 0.3 | 7.0 | 152 |
| 30 | 1.75 | 2.6 | 186 | 122 | 3.0 | 65 | 1.0 | 2.0 | 0.3 | 7.0 | 152 |
| 31 | 1.75 | 2.6 | 186 | 122 | 5.0 | 65 | 1.0 | 2.0 | 0.3 | 7.0 | 152 |
| 32 | 1.75 | 2.6 | 186 | 122 | 3.8 | 55 | 1.0 | 2.0 | 0.3 | 7.0 | 152 |
| 33 | 1.75 | 2.6 | 186 | 122 | 3.8 | 75 | 1.0 | 2.0 | 0.3 | 7.0 | 152 |
| 34 | 1.75 | 2.6 | 186 | 122 | 3.8 | 65 | 1.0 | 2.0 | 0.3 | 7.0 | 152 |
| 35 | 1.75 | 2.6 | 186 | 122 | 3.8 | 65 | 1.0 | 2.0 | 0.3 | 7.0 | 152 |
| 36 | 1.75 | 2.6 | 186 | 122 | 3.8 | 65 | 1.0 | 2.0 | 0.3 | 7.0 | 152 |
| 37 | 1.75 | 2.6 | 186 | 122 | 3.8 | 65 | 1.0 | 2.0 | 0.3 | 7.0 | 152 |
| 38 | 1.75 | 2.6 | 186 | 122 | 3.8 | 65 | 1.0 | 2.0 | 0.3 | 7.0 | 152 |
| 39 | 1.75 | 2.6 | 186 | 122 | 3.8 | 65 | 0 | | | | |
| 40 | 1.75 | 2.6 | 186 | 122 | 3.8 | 65 | 6.0 | 2.0 | 0.3 | 7.0 | 152 |
| 41 | 1.75 | 2.6 | 186 | 122 | 3.8 | 65 | 1.0 | 2.0 | 0.3 | 5.0 | 152 |
| 42 | 1.75 | 2.6 | 186 | 122 | 3.8 | 65 | 1.0 | 2.0 | 0.3 | 10.0 | 152 |
| 43 | 1.75 | 2.6 | 186 | 122 | 3.8 | 65 | 1.0 | 2.0 | 0.3 | 7.0 | 135 |
| 44 | 1.75 | 2.6 | 186 | 122 | 3.8 | 65 | 1.0 | 2.0 | 0.3 | 7.0 | 170 |

TABLE 3-continued

| Example | Carbon Black | | | | |
|---|---|---|---|---|---|
| | Carbon | Added amount (parts) | DBP Absorption Oil Amount (ml/100 g) | Primary Particle Diameter (nm) | Volatile Component (%) |
| 21 | Degussa Printex 70 | 10 | 123 | 18 | 1.2 |
| 22 | Degussa Printex 70 | 10 | 123 | 18 | 1.2 |
| 23 | Degussa Printex 70 | 10 | 100 | 22 | 1.5 |
| 24 | Degussa Printex 70 | 10 | 123 | 18 | 1.2 |
| 25 | Degussa Printex 70 | 10 | 123 | 18 | 1.2 |
| 26 | Degussa Printex 70 | 10 | 123 | 18 | 1.2 |
| 27 | Degussa Printex 70 | 10 | 123 | 18 | 1.2 |
| 28 | Degussa Printex 70 | 10 | 123 | 18 | 1.2 |
| 29 | Degussa Printex 70 | 10 | 123 | 18 | 1.2 |
| 30 | Degussa Printex 70 | 10 | 123 | 18 | 1.2 |
| 31 | Degussa Printex 70 | 10 | 123 | 18 | 1.2 |
| 32 | Degussa Printex 70 | 10 | 123 | 18 | 1.2 |
| 33 | Degussa Printex 70 | 10 | 123 | 18 | 1.2 |
| 34 | Degussa Printex 95 | 10 | 52 | 15 | 1.0 |
| 35 | Degussa Printex A | 10 | 118 | 41 | 0.7 |
| 36 | MITSUBISHI CHEMICAL OIL 31B | 10 | 107 | 30 | 5.5 |
| 37 | Degussa Printex 70 | 3 | 123 | 18 | 1.2 |
| 38 | Degussa Printex 70 | 13 | 123 | 18 | 1.2 |
| 39 | Degussa Printex 70 | 10 | 123 | 18 | 1.2 |
| 40 | Degussa Printex 70 | 10 | 123 | 18 | 1.2 |
| 41 | Degussa Printex 70 | 10 | 123 | 18 | 1.2 |
| 42 | Degussa Printex 70 | 10 | 123 | 18 | 1.2 |
| 43 | Degussa Printex 70 | 10 | 123 | 18 | 1.2 |
| 44 | Degussa Printex 70 | 10 | 123 | 18 | 1.2 |

The wax encapsulated in advance within the binder resin was low molecular weight polypropylene. Here, the domain diameter means the longest dimension of the wax dispersed within the binder resin. If two high polymer substances incompatible with each other are mixed, the two substances are segregated from each other due to the difference in boundary tension, so that the high polymer substance which is of a lower amount in the mixture will be dispersed in isolated forms or like islands within the high molecular weight substance which is of a greater amount in the mixture. This island structure is termed a domain, which is of a liquid form and has an approximately spherical shape. In the case of the present invention, the high polymer substance being of a greater amount is the resin and the one being of a lower amount is the wax. That is, the wax will be dispersed in island (domain) forms inside the resin.

The diameter was measured by dissolving the binder resin to be evaluated into tetrahydrofuran (THF), collecting the THF insoluble component using a membrane filter having a mesh diameter of 0.1 $\mu$m, and observing the filter using a SEM (S2500) of Hitachi, Ltd. The viscoelasticity was measured by a Rheometer RDS-7700 (a product of Rheometrics). The molecular weight distribution, that is, the number average molecular weight (HpMn) of the high polymer component and the number average molecular weight (LpMn) of the low molecular weight component were measured by an LC6A (SHIMADZU CORPORATION).

EXAMPLE 21

Loaded in a mixer (SUPER MIXER: a product of KAWATA CO., LTD.), 100 parts by weight of the binder resin shown in 'example 21' of Table 3 above, having 1.0 part by weight of the wax encapsulated therein, 10 parts by weight of carbon black (Printex 70: a product of Degussa Corporation) as a coloring agent and 1.5 parts of a quaternary ammonium salt (P-51: a product of ORIENT CHEMICAL INDUSTRY CO., LTD.) as a charge control agent, and these compounds are mixed to prepare an ingredient mixture for toner.

Next, the above-prepared ingredient mixture was loaded into a biaxial kneader (PCM65: a product of IKEGAI CORPORATION) as a kneader. The kneading cylinder was set at 150° C. (kneading temperature) so that the mixture was fused and kneaded. Thereafter, the mixed and kneaded ingredient was crushed and classified to so that a toner having a mean particle size of about 10.0 $\mu$m was obtained.

Then, 100 parts by weight of the toner thus obtained from the above production process was loaded into the aforementioned mixer, and 0.1 part by weight of silica powder (R972: a product of NIPPON AEROSIL CO., LTD.) and 0.1 part by weight of magnetite powder (KBC100: a product of KANTO DENKA KOGYO CO., LTD) were externally added thereto and mixed together, thus producing an externally additive-treated toner.

Further, 4 parts by weight of the externally additive-treated toner and 100 parts by weight of ferrite carriers made up of ferrite cores coated with a silicone resin were loaded into, a mixer, specifically, Nauta mixer (a product of Hosokawa Micron Corporation) and agitated and mixed thus producing a two component developer.

The diameter of the dispersed wax in the thus obtained toner particles, especially, the domain diameter was measured in the same manner as in the above-described measurement of the diameter of the dispersed particles within the binder resin. As a result, the diameter was 1.0 $\mu$m.

With a correct amount of the thus obtained two component developer supplied to the developing hopper, a 100K sheet actual copy run was performed in SD-4085 copier whilst the externally additive-treated toner as the supplement toner was being supplied as required. This actual copy run was performed in a 25° C., RH 60% atmosphere.

The resulting copies were stable in image density from the initial copy up to 100K, and good image quality could be maintained, without fogging as well as free of filming over the photoreceptor surface. This result is shown in Table 4.

Table 4 shows the evaluation results of the toners obtained in examples 22 through 44 (shown hereinbelow) in order to compare these toners with that obtained in example 1. Here, the image density and fogging in N mode and P mode are the same as described with reference to the evaluation result in Table 2.

While the conditions for the manufacturing of the toner shown in example 21 are not specified exactly, setting up the domain diameter of the wax in the binder resin within the specified range can regulate the domain diameter of the dispersed wax after the production. This scheme can provide a beneficial dispersion, and the results shown in Table 4 above are owing to this.

The evaluation result is shown in Table 4. The evaluation result of this toner obtained in example 22 exhibited image density and fogging which were of an allowable level, but the anti-filming performance, the anti-setoff performance and the preservability were poor. It is conceivable that the domain diameter of the dispersed wax encapsulated was large and hence the dispersed diameter after the production resultantly became large, thus having adverse effect on the dispersion performance etc.

EXAMPLE 23

The binder resin and coloring agent prescribed in 'example 23' in Table 3 and the charge control agent were blended under the same conditions as in example 21 to prepare a mixture of ingredients for a toner. In this example 23, a toner for electrophotography was prepared in the same manner and under the same conditions as in example 21, except that the domain diameter of the wax encapsulated within the binder resin was 0.8 $\mu$m. From measurement the domain diameter of the wax dispersed within the toner thus produced was found to be 0.05 $\mu$m.

A 100K copy run was achieved using this toner for electrophotography in a similar copier to that of example 21. The result is shown in Table 4. The evaluation result of this toner obtained in example 23 exhibited image density and fogging which were of an allowable level, but showed a poor anti-setoff performance and a slight inferiority in anti-filming performance compared to that of example 21. It is conceivable that the domain diameter of the dispersed wax encapsulated was too small and hence the wax could not be dispersed successfully within the toner, thus degrading the anti-setoff performance.

TABLE 4

| | Image Density | | | | Fogging | | | | | | | | |
|---|---|---|---|---|---|---|---|---|---|---|---|---|---|
| | Initial Stage | | 100K | | Initial Stage | | 100K | | Anti- | | Anti- | Anti- | |
| Example | N mode | P mode | N mode | P mode | N mode | P mode | N mode | P mode | filming | Fixing | aging | setoff | Preservability |
| 21 | 1.41 | 1.15 | 1.39 | 1.15 | 0.32 | 0.40 | 0.31 | 0.34 | ○ | ○ | ○ | ○ | ○ |
| 22 | 1.41 | 1.15 | 1.39 | 1.15 | 1.62 | 1.55 | 1.88 | 1.56 | X | ○ | ○ | Δ | X |
| 23 | 1.42 | 1.17 | 1.38 | 1.12 | 1.59 | 1.61 | 1.99 | 1.64 | Δ | ○ | ○ | X | ○ |
| 24 | 1.41 | 1.16 | 1.35 | 1.20 | 0.35 | 0.42 | 0.32 | 0.35 | X | ○ | X | X | Δ |
| 25 | 1.40 | 1.17 | 1.36 | 1.22 | 0.34 | 0.39 | 0.52 | 0.59 | ○ | X | ○ | ○ | ○ |
| 26 | 1.41 | 1.15 | 1.21 | 1.00 | 0.36 | 0.42 | 0.32 | 0.35 | X | ○ | X | X | Δ |
| 27 | 1.40 | 1.12 | 1.38 | 1.14 | 0.39 | 0.48 | 0.38 | 0.46 | ○ | X | ○ | ○ | ○ |
| 28 | 1.43 | 1.14 | 1.42 | 1.11 | 0.45 | 0.55 | 0.39 | 0.41 | Δ | ○ | Δ | X | Δ |
| 29 | 1.44 | 1.15 | 1.40 | 1.16 | 0.33 | 0.35 | 0.44 | 0.50 | ○ | X | ○ | Δ | ○ |
| 30 | 1.41 | 1.13 | 1.39 | 1.12 | 0.40 | 0.39 | 0.39 | 0.44 | ○ | ○ | ○ | X | Δ |
| 31 | 1.49 | 1.16 | 1.48 | 1.17 | 1.58 | 1.55 | 2.12 | 2.35 | ○ | X | ○ | ○ | ○ |
| 32 | 1.39 | 1.13 | 1.38 | 1.12 | 0.33 | 0.33 | 0.40 | 0.39 | Δ | ○ | Δ | Δ | X |
| 33 | 1.41 | 1.15 | 1.41 | 1.15 | 0.40 | 0.45 | 0.41 | 0.46 | ○ | X | ○ | Δ | ○ |
| 34 | 1.31 | 1.03 | 1.29 | 0.98 | 0.40 | 0.42 | 0.42 | 0.44 | X | ○ | X | X | ○ |
| 35 | 1.30 | 1.00 | 1.26 | 0.99 | 0.42 | 0.44 | 0.48 | 0.51 | X | ○ | X | X | ○ |
| 36 | 1.40 | 1.13 | 1.40 | 1.13 | 1.72 | 1.49 | 1.92 | 1.45 | ○ | X | ○ | X | ○ |
| 37 | 1.20 | 0.90 | 1.10 | 0.80 | 0.33 | 0.41 | 0.32 | 0.35 | Δ | ○ | Δ | Δ | ○ |
| 38 | 1.50 | 1.35 | 1.45 | 1.35 | 1.81 | 1.35 | 2.00 | 1.45 | ○ | ○ | ○ | ○ | ○ |
| 39 | 1.41 | 1.15 | 1.39 | 1.15 | 0.32 | 0.40 | 0.31 | 0.44 | ○ | ○ | ○ | X | ○ |
| 40 | 1.44 | 1.19 | 1.35 | 1.14 | 0.28 | 0.51 | 0.28 | 0.34 | X | ○ | Δ | ○ | Δ |
| 41 | 1.43 | 1.11 | 1.41 | 1.09 | 0.33 | 0.41 | 0.29 | 0.25 | Δ | ○ | X | ○ | X |
| 42 | 1.45 | 1.15 | 1.41 | 1.13 | 0.55 | 0.45 | 0.61 | 0.51 | ○ | X | ○ | X | ○ |
| 43 | 1.40 | 1.10 | 1.39 | 1.11 | 0.44 | 0.47 | 0.51 | 0.61 | Δ | ○ | X | ○ | X |
| 44 | 1.45 | 1.13 | 1.36 | 1.13 | 0.33 | 0.39 | 0.41 | 0.29 | ○ | X | ○ | X | ○ |

Evaluation
○: good
Δ: usual
X: bad

The following examples are shown for comparison in order to make the toner obtained in example 21 more distinct.

EXAMPLE 22

The binder resin and coloring agent prescribed in 'example 22' in Table 3 and the charge control agent were blended under the same conditions as in example 21 to prepare a mixture of ingredients for a toner. In this example 22, a toner for electrophotography was prepared in the same manner and under the same conditions as in example 21, except that the domain diameter of the wax encapsulated within the binder resin was 6.0 $\mu$m. From measurement, the domain diameter of the wax dispersed within the toner thus produced was found to be 2.0 $\mu$m.

A 100K copy run was achieved using this toner for electrophotography in a similar copier to that of example 21.

EXAMPLE 24

The binder resin and coloring agent prescribed in 'example 24' in Table 3 and the charge control agent were blended under the same conditions as in example 21 to prepare a mixture of ingredients for a toner. In this example 24, a toner for electrophotography was prepared in the same manner and under the same conditions as in example 21, except that the HpMn of the high polymer component of the binder resin was $0.8\times10^5$ and the LpMn of the low molecular weight component was $1.5\times10^3$.

A 100K copy run was achieved using this toner for electrophotography in a similar copier to that of example 21. The evaluation result is shown in Table 4. The evaluation result of this toner obtained in example 24 exhibited the image density and fogging which were of an allowable level, but the anti-filming performance, the anti-aging performance and the anti-setoff performance were poor.

EXAMPLE 25

The binder resin and coloring agent prescribed in 'example 25' in Table 3 and the charge control agent were blended under the same conditions as in example 21 to prepare a mixture of ingredients for a toner. In this example 25, a toner for electrophotography was prepared in the same manner and under the same conditions as in example 21, except that the HpMn of the high polymer component of the binder resin was $3.0\times10^5$ and the LpMn of the low molecular weight component was $3.5\times10^3$.

A 100K copy run was achieved using this toner for electrophotography in a similar copier to that of example 21. The evaluation result is shown in Table 4. The evaluation result of this toner obtained in example 25 exhibited image density and fogging which were of an allowable level and showed some improvement as to the problems of the anti-filming performance, the anti-aging performance, the anti-setoff performance, etc., of example 24, but an inferiority in fixing performance.

EXAMPLE 26

The binder resin and coloring agent prescribed in 'example 26' in Table 3 and the charge control agent were blended under the same conditions as in example 21 to prepare a mixture of ingredients for a toner. In this example 26, a toner for electrophotography was prepared in the same manner and under the same conditions as in example 21, except that the preservation elasticity G (represented in terms of a temperature when the modulus of elasticity is equal to 1 ($N/cm^2$)) of the resin as the binder resin was 150° C.

A 100K copy run was achieved using this toner for electrophotography in a similar copier to that of example 21. The evaluation result is shown in Table 4. The evaluation result of this toner obtained in example 26 exhibited image density and fogging which were of an allowable level, but showed poor anti-filming performance, anti-aging performance and anti-setoff performance.

EXAMPLE 27

The binder resin and coloring agent prescribed in 'example 27' in Table 3 and the charge control agent were blended under the same conditions as in example 21 to prepare a mixture of ingredients for a toner. In this example 27, a toner for electrophotography was prepared in the same manner and under the same conditions as in example 21, except that the preservation elasticity G (represented in terms of a temperature when the modulus of elasticity is equal to 1 ($N/cm^2$)) of the resin as the binder resin was 220° C.

A 100K copy run was achieved using this toner for electrophotography in a similar copier to that of example 21. The evaluation result is shown in Table 4. The evaluation result of this toner obtained in example 27 exhibited image density and fogging which were of an allowable level, and showed elimination of the problems associated with the anti-filming performance, the anti-aging performance, the anti-setoff performance, etc., of example 26, but showed an inferiority in fixing performance.

EXAMPLE 28

The binder resin and coloring agent prescribed in 'example 28' in Table 3 and the charge control agent were blended under the same conditions as in example 21 to prepare a mixture of ingredients for a toner. In this example 28, a toner for electrophotography was prepared in the same manner and under the same conditions as in example 21, except that the melt viscosity Tη (the temperature at which the complex modulus of viscosity $|\eta^*|$ becomes equal to 1000 Pa·s) of the resin as the binder resin was 110° C.

A 100K copy run was achieved using this toner for electrophotography in a similar copier to that of example 21. The evaluation result is shown in Table 4. The evaluation result of this toner obtained in example 28 exhibited image density and fogging which were of an allowable level, but showed a poor anti-setoff performance.

EXAMPLE 29

The binder resin and coloring agent prescribed in 'example 29' in Table 3 and the charge control agent were blended under the same conditions as in example 21 to prepare a mixture of ingredients for a toner. In this example 29, a toner for electrophotography was prepared in the same manner and under the same conditions as in example 21, except that the melt viscosity Tη (the temperature at which the complex modulus of viscosity $|\eta^*|$ becomes equal to 1000 Pa·s) of the resin as the binder resin was 140° C.

A 100K copy run was achieved using this toner for electrophotography in a similar copier to that of example 21. The evaluation result is shown in Table 4. The evaluation result of this toner obtained in example 29 exhibited image density and fogging which were of an allowable level, and showed elimination of the problem of the anti-setoff performance of example 28, but showed an inferiority in fixing performance.

EXAMPLE 30

The binder resin and coloring agent prescribed in 'example 30' in Table 3 and the charge control agent were blended under the same conditions as in example 21 to prepare a mixture of ingredients for a toner. In this example 30, a toner for electrophotography was prepared in the same manner and under the same conditions as in example 21, except that the loss elasticity G' of the resin as the binder resin was 3.4 ($N/cm^2$) at 140° C.

A 100K copy run was achieved using this toner for electrophotography in a similar copier to that of example 21. The evaluation result is shown in Table 4. The evaluation result of this toner obtained in example 30 exhibited image density and fogging which were of an allowable level, but showed a poor anti-setoff performance.

EXAMPLE 31

The binder resin and coloring agent prescribed in 'example 31' in Table 3 and the charge control agent were blended under the same conditions as in example 21 to prepare a mixture of ingredients for a toner. In this example 31, a toner for electrophotography was prepared in the same manner and under the same conditions as in example 21, except that the loss elasticity G' of the resin as the binder resin was 5.0 ($N/cm^2$) at 140° C.

A 100K copy run was achieved using this toner for electrophotography in a similar copier to that of example 21. The evaluation result is shown in Table 4. The evaluation result of this toner obtained in example 31 produced an image having an allowable level of image density but a high level of fogging because the static charge distribution had a wide spread containing many toner particles having the opposite polarity. The problem of the anti-setoff performance in example 30 could be eliminated but the fixing performance was degraded significantly.

EXAMPLE 32

The binder resin and coloring agent prescribed in 'example 32' in Table 3 and the charge control agent were blended under the same conditions as in example 21 to prepare a mixture of ingredients for a toner. In this example 32, a toner for electrophotography was prepared in the same manner and under the same conditions as in example 21, except that the glass-transition temperature (° C.) of the binder resin was at 55° C.

A 100K copy run was achieved using this toner for electrophotography in a similar copier to that of example 21. The evaluation result is shown in Table 4. The evaluation result of this toner obtained in example 32 exhibited image density and fogging which were of an allowable level, but showed a poor preservability.

EXAMPLE 33

The binder resin and coloring agent prescribed in 'example 33' in Table 3 and the charge control agent were blended under the same conditions as in example 21 to prepare a mixture of ingredients for a toner. In this example 33, a toner for electrophotography was prepared in the same manner and under the same conditions as in example 21, except that the glass-transition temperature (° C.) of the binder resin was at 75° C.

A 100K copy run was achieved using this toner for electrophotography in a similar copier to that of example 21. The evaluation result is shown in Table 4. The evaluation result of this toner obtained in example 33 exhibited image density and fogging which were of an allowable level, and elimination of the preservability problem in example 32, but showed an inferiority in fixing performance to example 32.

EXAMPLE 34

The binder resin and coloring agent prescribed in 'example 34' in Table 3 and the charge control agent were blended under the same conditions as in example 21 to prepare a mixture of ingredients for a toner. In this example 34, a toner for electrophotography was prepared under the same conditions as in example 21, except that a different type of carbon black (Printex 95: a product of Degussa Corporation) was used as the coloring agent. This carbon black has a DBP oil absorption of 52 (ml/100 g).

A 100K copy run was achieved using this toner for electrophotography in a similar copier to that of example 21. The evaluation result is shown in Table 4. The evaluation result of this toner obtained in example 34 exhibited a low image density from the initial stage, and no signs of recovery. Fogging was not so bad, but filming arose over the photoreceptor and the anti-aging performance and anti-setoff performance became poor after a 100K run.

EXAMPLE 35

The binder resin and coloring agent prescribed in 'example 35' in Table 3 and the charge control agent were blended under the same conditions as in example 21 to prepare a mixture of ingredients for a toner. In this example 35, a toner for electrophotography was prepared under the same conditions as in example 21, except that a different type of carbon black (Printex A: a product of Degussa Corporation) was used as the coloring agent. This carbon black has a primary particle diameter of 41 (nm) and content of volatile component is low (0.7%).

A 100K copy run was achieved using this toner for electrophotography in a similar copier to that of example 21. The evaluation result is shown in Table 4. The evaluation result of this toner obtained in example 35 exhibited a low image density from the initial stage, and no signs of recovery. Fogging was not so bad, but filming arose over the photoreceptor and the anti-aging performance and anti-setoff performance became poor after a 100K run.

EXAMPLE 36

The binder resin and coloring agent prescribed in 'example 36' in Table 3 and the charge control agent were blended under the same conditions as in example 21 to prepare a mixture of ingredients for a toner. In this example 36, a toner for electrophotography was prepared under the same conditions and using the same materials as in example 21, except that a different type of carbon black (OIL31B: a product of MITSUBISHI CHEMICAL CORPORATION) was used as the coloring agent. In this carbon black, content of volatile component is very high (5.5%), and has a relatively large DBP oil absorption of 107 (ml/100 g) and a relatively large primary particle diameter of 30 (nm).

A 100K copy run was achieved using this toner for electrophotography in a similar copier to that of example 21. The evaluation result is shown in Table 4. The evaluation result of this toner obtained in example 36 exhibited a retention of image density but showed a reduced static charge and hence produced a foggy image. The anti-setoff performance and the fixing performance were degraded.

EXAMPLE 37

The binder resin and coloring agent prescribed in 'example 37' in Table 3 and the charge control agent were blended under the same conditions as in example 21 to prepare a mixture of ingredients for a toner. In this example 37, a toner for electrophotography was prepared under the same conditions as in example 21, except that the added amount of carbon black as the coloring agent was changed to 3 parts by weight.

A 100K copy run was achieved using this toner for electrophotography in a similar copier to that of example 21. The evaluation result is shown in Table 4. The evaluation result of this toner obtained in example 37 showed that the toner was low in hiding power, and tended to bear a high amount of static charge, hence produced a low image density. Further, the anti-filming performance and the anti-aging performance were poor and the anti-setoff performance was somewhat lacking.

EXAMPLE 38

The binder resin and coloring agent prescribed in 'example 38' in Table 3 and the charge control agent were blended under the same conditions as in example 21 to prepare a mixture of ingredients for a toner. In this example 38, a toner for electrophotography was prepared under the same conditions as in example 21, except that the added amount of carbon black as the coloring agent was changed to 13 parts by weight.

A 100K copy run was achieved using this toner for electrophotography in a similar copier to that of example 21. The evaluation result is shown in Table 4. The evaluation result of this toner obtained in example 38 exhibited normal image density, but showed an insufficiency in the amount of static charge and hence produced a foggy image. However, the anti-filming performance, the anti-aging performance, the anti-setoff performance, the fixing performance and the preservability were all excellent.

EXAMPLE 39

The binder resin and coloring agent prescribed in 'example 39' in Table 3 and the charge control agent were blended under the same conditions as in example 21 to prepare a mixture of ingredients for a toner. In this example 39, a toner for electrophotography was prepared in the same manner and under the same conditions as in example 21, except that the content of the wax encapsulated within the binder resin was '0' that is, the binder contained no wax.

A 100K copy run was achieved using this toner for electrophotography in a similar copier to that of example 21. The evaluation result is shown in Table 4. The evaluation result of this toner obtained in example 39 exhibited image density and fogging which were of an allowable level, but showed a poor anti-setoff performance.

EXAMPLE 40

The binder resin and coloring agent prescribed in 'example 40' in Table 3 and the charge control agent were blended under the same conditions as in example 21 to prepare a mixture of ingredients for a toner. In this example 40, a toner for electrophotography was prepared in the same manner and under the same conditions as in example 21, except that the content of the wax encapsulated within the binder resin was 6.0 parts by weight.

A 100K copy run was achieved using this toner for electrophotography in a similar copier to that of example 21. The evaluation result is shown in Table 4. The evaluation result of this toner obtained in example 40 exhibited image density and fogging which were of an allowable level, and showed improvement as to the anti-setoff of example 39 but inferiority in anti-filming performance and anti-aging performance.

EXAMPLE 41

The binder resin and coloring agent prescribed in 'example 41' in Table 3 and the charge control agent were blended under the same conditions as in example 21 to prepare a mixture of ingredients for a toner. In this example 41, a toner for electrophotography was prepared in the same manner and under the same conditions as in example 21, except that the number average molecular weight Mn of the wax encapsulated within the binder resin was set at $5.0\times10^3$.

A 100K copy run was achieved using this toner for electrophotography in a similar copier to that of example 21. The evaluation result is shown in Table 4. The evaluation result of this toner obtained in example 41 exhibited image density and fogging which were of an allowable level, but showed lacking of the anti-filming performance, the anti-aging performance and preservability.

EXAMPLE 42

The binder resin and coloring agent prescribed in 'example 42' in Table 3 and the charge control agent were blended under the same conditions as in example 21 to prepare a mixture of ingredients for a toner. In this example 42, a toner for electrophotography was prepared in the same manner and under the same conditions as in example 21, except that the number average molecular weight Mn of the wax encapsulated within the binder resin was set at $10.0\times10^3$.

A 100K copy run was achieved using this toner for electrophotography in a similar copier to that of example 21. The evaluation result is shown in Table 4. The evaluation result of this toner obtained in example 42 exhibited image density and fogging which were of an allowable level, and showed improvement as to the anti-filming performance and the anti-aging performance, but showed inferiority in the anti-setoff performance and the fixing performance as compared to example 41.

EXAMPLE 43

The binder resin and coloring agent prescribed in 'example 43' in Table 3 and the charge control agent were blended under the same conditions as in example 21 to prepare a mixture of ingredients for a toner. In this example 43, a toner for electrophotography was prepared in the same manner and under the same conditions as in example 21, except that the softening point of the wax encapsulated within the binder resin was 135° C.

A 100K copy run was achieved using this toner for electrophotography in a similar copier to that of example 21. The evaluation result is shown in Table 4. The evaluation result of this toner obtained in example 43 exhibited image density and fogging which were of an allowable level, but showed lacking of the anti-filming performance, the anti-aging performance and preservability.

EXAMPLE 44

The binder resin and coloring agent prescribed in 'example 44' in Table 3 and the charge control agent were blended under the same conditions as in example 21 to prepare a mixture of ingredients for a toner. In this example 44, a toner for electrophotography was prepared in the same manner and under the same conditions as in example 21, except that the softening point of the wax encapsulated within the binder resin was 170° C.

A 100K copy run was achieved using this toner for electrophotography in a similar copier to that of example 21. The evaluation result is shown in Table 4. The evaluation result of this toner obtained in example 44 exhibited image density and fogging which were of an allowable level, and showed improvement as to the anti-filming performance and the anti-aging performance relative to example 43. However, the toner of example 44 showed inferiority in anti-setoff performance and fixing performance compared to example 43.

As seen from examples 21 through 44, on the basis of the evaluation results in Tables 3 and 4, the toner excellent in image density, fogging, anti-filming performance, anti-aging performance, anti-setoff performance, fixing performance and preservability is concluded to be that of example 21. When the toner of example 21 is compared with those of examples 22 and 23, it can be understood that the domain diameter of the wax has had a large influence on their performances.

If the domain diameter of the wax encapsulated within the binder resin is equal to 6.0 μm or above, the toner produces problems in anti-filming performance and preservability. If the domain diameter is 0.8 μm, the domain diameter of the wax dispersed in the toner after production will be 0.05 μm, and the toner exhibits the anti-setoff problem. As a result, it is important to select a binder resin in which a wax at least having a domain diameter of greater than 0.8 μm and below 6.0 μm is encapsulated. It is very preferred that the domain diameter of the wax encapsulated in the binder resin preferably fall within the range of 1.0 μm or greater and 3.0 μm or less.

Further, within the above range of the domain diameter encapsulated in the binder resin, the domain diameter of the wax dispersed in the toner after production preferably falls within a range which is in excess of 0.05 μm and smaller than 2.0 μm. In particular, the domain diameter of the wax in the toner most preferably falls within the range of 0.1 μm to 1.0 μm.

Thus, by specifying the domain diameter of the wax encapsulated in the binder resin within the above range, it is possible to regulate the domain diameter of the wax dispersed in the toner after production within the appropriate range. As an exemplary result showing good dispersion performance of the wax, example 21 shown in Table 4 can be referred to. This means that it is not necessary to strictly limit the manufacturing conditions, and hence the production process can be simplified.

To produce a further beneficial result over and above the state where the domain diameter of the wax encapsulated in the binder resin falls within the proper range as specified above, the number average molecular weight Mn of the binder resin needs to be controlled as understood from examples 24 and 25.

As to the number average molecular weight Mn of the binder resin, from comparison with example 21, when the number average molecular weight Mn of the high polymer component was $1.75\times10^5$ a good result could be obtained whereas the result was problematical if the number average molecular weight Mn was $0.8\times10^5$ as in example 24 and was $3.0\times10^5$ as in example 25. Therefore, a good result is obtained around the value of example 21, so that the number average molecular weight Mn should be set within the range between examples 24 and 25. This situation is the same as in the first embodiment, and a good result can be obtained if the number average molecular weight Mn of the high polymer component of the binder resin is set within the range of $1.0\times10^5$ to $2.5\times10^5$.

The limitations as to the number average molecular weight Mn of the binder resin are the same as in the first embodiment, and if it falls within the range of $2.0\times10^3$ to $3.2\times10^3$, a good result can be obtained.

It is understood from the comparison of example 21 with examples 26 and 27, a good result can be obtained if the preservation elasticity of the binder resin, represented in terms of a temperature when the modulus of elasticity is equal to 1 ($N/cm^2$) is around 186° C. From examples 26 and 27, if the preservation elasticity of the binder resin is not higher than 150° C., the anti-filming and the anti-setoff performances degrade, whereas if it is 220° C. or above, the fixing performance degrades while the anti-filming performance and the setoff performance are improved. Therefore, if the preservation elasticity of the binder resin is set within a range of at least 180° C. but lower than 200° C., a good result can be obtained.

To sum up, the viscoelasticity of the binder resin strongly correlate with the fixing, anti-setoff and material dispersion performances of the toner. In a case of a high polymer resin for a high speed operation, the fixing, anti-setoff and material dispersion performances tend to lower. In this respect, it is possible to modify the resin for a high speed operation so as to have beneficial fixing, anti-setoff and material dispersion performances, by optimizing the viscoelastic properties. Again, as stated above, the temperature at which the preservation elasticity is equal to 1 ($N/cm^2$) strongly correlates withthe anti-setoff performance. Actually, as the temperature becomes higher, the temperature at which a high temperature setoff arises becomes higher, but then again the fixing performance degrades. Therefore, it is possible to keep the anti-setoff performance and the fixing performance good when the preservation elasticity is set within the above range.

Comparing example 21 with examples 28 and 29, it is found that a good result can be obtained when the melt viscosity Tη (the temperature at which the complex modulus of viscosity $|\eta^*|$ becomes equal to 1000 Pa·s) of the binder resin is around 122° C., and the anti-setoff performance degrades when the melt viscosity is 110° C. or below and the fixing performance degrades when the melt viscosity is 140° C. or above. Therefore, a good result can be obtained when the melt viscosity Tη of the binder resin is set within the range of 120° C. to 130° C.

This is owing to the fact that the melt viscosity Tη (the temperature at which the complex modulus of viscosity $|\eta^*|$ becomes equal to 1000 Pa·s) strongly correlates with the fixing performance. Actually, if the melt viscosity Tη is low, a better fixing performance can be obtained while the anti-setoff performance is lowered. On the contrary, if the melt viscosity Tη is high, the fixing performance degrades while the anti-setoff performance tends to be improved. Thus, in this invention, it is possible to fulfill satisfactory levels of the anti-setoff performance and the fixing performance when the melt viscosity Tη is set within the above range.

Comparing example 21 with examples 30 and 31, it is found that a good result can be obtained when the loss elasticity of the binder resin at 140° C. is around 3.8 $N/cm^2$, and the anti-setoff performance degrades when the loss elasticity is 3.0 ($N/cm^2$) or below while the fixing performance degrades when the loss elasticity is 5.0 ($N/cm^2$)or above. Therefore, a good result inclusive of the setoff performance and the fixing performance can be obtained when the loss elasticity of the binder resin is set within the range of 3.4 ($N/cm^2$) to 4.5 ($N/cm^2$).

This loss elasticity at 140° C. strongly correlates with the fixing performance, anti-setoff performance and the material dispersion performance. If the loss elasticity is low, good fixing and material dispersion performances can be obtained while the anti-setoff performance degrades. If the loss elasticity is high, the fixing performance degraded but the anti-setoff and material dispersion performances tend to be improved. Thus, it is possible to keep the material dispersion performance good as well as the anti-setoff performance and the fixing performance when the loss elasticity is set within the above range. Therefore, the dispersion performance of the wax contained within the binder resin can also be improved.

Comparing example 21 with examples 32 and 33, it is found from example 21 that a good result can be obtained when the glass-transition temperature Tg of the binder resin is around 65° C. If it is 55° C. or below the preservability is found to be problematic from the result of example 32 while from the result of example 33 if it is 75° C. or above, the fixing performance becomes problematic due to fusion or other problems. Accordingly, setting the glass-transition temperature Tg of the binder resin within the range of 60° C. to 750°, makes it possible to solve the problems of preservability and fixing performance.

As a matter of fact, the glass-transition temperature Tg strongly correlates with the preservability of the toner. Accordingly, if this value is small, the preservability is bad. On the other hand, if this value is large, the problem of fixing performance arises while the preservability is good. Therefore, it is possible to secure high enough preservability and fixing performance by setting the glass-transition temperature Tg within the aforementioned range.

Apart from the binder resin described heretofore, other materials constituting a toner, namely, carbon black as the coloring agent, will also produce various problems. Therefore, specifying the properties of carbon black is effective in obtaining a more beneficial result.

For this purpose, example 21 is compared with examples 34 through 36. From this comparison, it is found that unless the DBP oil absorption, the primary particle size and the volatile component are set within their appropriate ranges, the anti-filming performance, the anti-aging performance and the anti-setoff performance etc., show problems.

For example, it is understood from example 34 that when the DBP oil absorption is as low as 52 (ml/100 l g), the fixing performance and the anti-setoff performance show bad results. This can be explained as follows. Typically, carbon black takes the form of a string-like structure of primary particles and such structures are dispersed in the toner. The dimensions of this structure strongly correlate with the degree of blackness, fixing performance and anti-setoff performance of the toner itself. In general, it is known that the shorter the structure, the better the above performances tend to be. The DBP oil absorption is one of the indices representing the dimensions of the structure. That is, it is known that the greater the oil absorption, the smaller the structure. Therefore, it is possible to obtain a toner excellent in degree of blackness, fixing performance and anti-setoff performance by specifying the DBP oil absorption. From the result of example 34 etc., it is important to set the DBP oil absorption greater than 52 (ml/100 g) and preferably at least 90 (ml/100 g) or more.

When the primary particle size is as large as 41 (nm) as in example 35, the anti-setoff performance and fixing performance are poor. This is because the primary particle size of the carbon black strongly correlates with the toner viscoelasticity and the degree of blackness. That is, it is known that the smaller the primary particle size of carbon black, the better the viscoelasticity and the degree of blackness tend to be. Therefore, by selecting a type of carbon black, as the coloring agent, having a smaller primary particle size than 41 (nm) as in example 35, it is possible to improve the degree of blackness of the toner, the fixing performance represented by the viscoelasticity and the anti-setoff performance. In this case, also taking into consideration the result of example 21, setting of the primary particle diameter of this coloring agent smaller than 30 (nm) makes it possible to produce a good result.

Further, the carbon black used in example 36 is very high in its volatile component (5.5%). This degrades the charge performance and the fixing performance and anti-setoff performance. As compared with this, the amount of the volatile component in example 21 is very small, specifically 1.2%. Therefore, the fixing performance can be improved when the volatile component of carbon black as the coloring agent is limited to less than 2.0%.

Carbon black as the coloring agent contains a variety of impurities, which are generally known to have a strong negative charge characteristic and to obstruct the improvement of the elasticity of the resin. Further, the more of these impurities the carbon black contains, the more the volatile component. Therefore, limitation of the volatile component of the coloring agent as above, makes it possible to produce a toner excellent in its charge characteristics and improves the elasticity of the binder resin and hence improves the fixing and anti-setoff performances etc., of the toner.

Carbon black has a high hiding power. On the other hand, it also presents a high conductivity. Therefore, addition of only a small amount of carbon black produces an insufficiency in degree of blackness, and gives a high resistance and hence produces a high static charge, degrading the hiding power. In contrast, addition of a large amount of carbon black increases the hiding power, but lowers the resistance and hence causes toner scatter and fogging.

For this reason, the carbon black content shown in examples 37 and 38 are not pertinent. Therefore, carbon black should be added four parts by weight to 15 parts by weight in order to achieve a beneficial degree of blackness as well as improved fixing and anti-setoff performances. This limitation provides a good result.

The amount of the wax to be encapsulated within the binder resin is determined, and becomes apparent by, comparing the results of examples 39 and 40 with that of example 21. When no wax is encapsulated, the anti-setoff performance is poor. When plenty of wax is added, the anti-filming performance becomes problematical. Therefore, the encapsulated amount of the wax should be at least 1.0 parts by weight from the result of example 21, and should be at most 6.0 part by weight, preferably 5.0 parts by weight or below, in order to achieve improved anti-filming and anti-setoff performances.

Concerning the wax, the dispersed diameter and the added amount of the wax within the toner strongly correlate with the anti-setoff performance and the anti-filming performance. Limitation of the added amount of the wax as above makes it possible to improve the anti-setoff and anti-filming performances.

The number average molecular weight Mn of the wax encapsulated in the binder resin is determined and becomes apparent by comparing the results of examples 41 and 42 with that of example 21. When the number average molecular weight Mn of the wax encapsulated is low, this produces problems in anti-aging performance and preservability, and if it is high, the anti-aging performance and the preservability are improved while the setoff and fixing performances degrade. Therefore, the number average molecular weight Mn of the wax encapsulated in the binder resin is preferably of a wax having low molecular weight from 6,000 to 8,000, such as polypropylene wax.

In this case, the number average molecular weight of the low molecular weight component in the binder resin is over $3.2\times10^3$ and the number average molecular weight of the high polymer component is less than $1.0\times10^5$.

Next, the softening temperature of the wax encapsulated in the binder resin is as low as 135° C. in example 43 and is as high as 170° C. in example 44. From these results, when the softening temperature of the wax is low, the anti-aging performance and preservability are bad whereas when the softening temperature is high, the anti-aging performance and preservability are improved but the anti-setoff and fixing performances become problematical. Accordingly, taking these results into consideration, the above problems can be solved by setting the softening temperature at around 152° C., similar to that of the wax encapsulated in the binder resin in example 21. Resultantly, a low molecular weight wax of which the softening temperature falls within the range of 145° C. to 165° C. is preferable.

In particular, the dispersion diameter of the wax in the resin is largely affected by the softening temperature of the wax. While the wax is encapsulated into the binder resin during the production process of the resin by solution polymerization method, the softening temperature of the wax is important in order to obtain an optimized dispersion diameter. The softening temperature is optimal if it falls within the above range, whereby it is possible to produce a good dispersion performance and resultantly provide improved anti-setoff and anti-filming performances of the toner.

All the examples described heretofore are of a two component developer in which the toner are mixed with carriers. However, the toner of the present invention can of course be used as a developer of a single component toner (externally additive-treated one). When a single component toner is used as a magnetic toner, it can be easily obtained by adding a magnetic substance, in addition to the coloring agent, charge control agent and the like, into the binder resin. The thus obtained single component magnetic toner can sufficiently present the advantages described with reference to the above examples, and prevent variations in image density and increase in fogging and the occurrence of filming phenomenon, etc. At the same time it is possible to obtain an beneficial toner which is excellent in fixing performance and free from the setoff phenomenon.

In accordance with the toner for electrophotography of the invention, it is possible to prevent the setoff phenomenon during the fixing process and at the same time, it is possible to beneficially prevent the filming phenomenon, that is, the adherence of the toner to the photoreceptor which would have occurred when the prevention of the setoff phenomenon was enhanced.

It is also possible to provide a toner having beneficial characteristics which will neither cause large variations in image density nor increase in fogging, and is also excellent in fixing performance.

Further, by regulating the kneading temperature during the kneading step in the toner production process, it is possible to easily obtain a toner which can further promote the aforementioned effects.

Moreover, by regulating the domain diameter of the wax dispersed and encapsulated in the binder resin, and by controlling the added amount, molecular weight and softening temperature of the wax, it is possible to regulate the domain diameter of the wax dispersed in the toner after production. These procedures make it possible to prevent both the setoff and filming phenomena.

In this case, the dispersion performance of the wax, and the domain diameter of the wax dispersed in the toner can be retained properly without optimizing the manufacturing conditions for toner production, whereby toner production process for producing a beneficial toner can be simplified and hence an inexpensive toner can be provided.

What is claimed is:

1. A toner production process for preparing a toner for electrophotography comprising the steps of:

a. encapsulating a wax within a binder resin to form a main component of the toner, wherein a domain diameter of the wax to be encapsulated in the binder resin falls within a range of 1.0 $\mu$m to 3.0 $\mu$m, and b. after step (a), fusing and kneading the binder resin and encapsulated wax and other toner ingredients to form the toner, wherein a domain diameter of wax particles dispersed in the toner after the fusing and kneading step (b) is within a range of of 0.1 $\mu$m to 1.0 $\mu$m.

2. A toner production process for preparing a toner for electrophotography according to claim 1, wherein the low molecular weight polypropylene wax is encapsulated in the resin at 0.5 part to 5 parts by weight of the wax for 100 parts by weight of the binder resin.

3. A toner production process for preparing a toner for electrophotography according to claim 1, wherein the wax is encapsulated in the binder resin at 0.1 part by weight or more of the wax and less than 5.0 parts by weight of the wax for 100 parts by weight of the binder resin.

4. A toner production process for preparing a toner according to claim 1, wherein an average molecular weight (Mn) of a high polymer component of the binder resin falls within a range of $1.0\times10^5 \leqq Mn \leqq 2.5\times10^5$, and an average molecular weight (Mn) of a low molecular weight component of the binder falls within a range of $2.0\times10^3 \leqq Mn \leqq 3.2\times10^3$.

5. A toner production process for preparing a toner for electrophotography according to claim 1, wherein an average molecular weight (Mn) of a high polymer component of the binder resin falls within a range of $1.0\times10^5 \leqq Mn \leqq 2.5\times10^5$, and an average molecular weight (Mn) of a low molecular weight component of the binder falls within a range of $2.0\times10^3 \leqq Mn \leqq 3.2\times10^3$.

6. A toner production process for preparing a toner for electrophotography according to claim 1, wherein the wax encapsulated in the binder resin is a low molecular weight polypropylene wax having an average molecular weight (Mn) of 6,000 to 8,000.

7. A toner production process for preparing a toner for electrophotography according to claim 1, wherein the wax encapsulated in the binder is a low molecular weight polypropylene wax having a softening temperature of 145° C. to 165° C.

8. A toner production process for preparing a toner for electrophotography, comprising the steps of:

while polymerizing a binder resin, which will form a main component of the toner, encapsulating within the resin a low molecular weight polyethylene wax having a dispersion diameter of 0.3 $\mu$m or less, and fusing and kneading a mixture of ingredients for the toner at a temperature in the range of M±5° C., where M° C. is a 4 mm softening temperature of the binder resin.

* * * * *